US010584512B2

(12) United States Patent
Zingerle

(10) Patent No.: US 10,584,512 B2
(45) Date of Patent: Mar. 10, 2020

(54) DEVICE FOR TENSIONING A FABRIC OF A TENT

(71) Applicant: Zingerlemetal AG, Natz/Schabs (IT)

(72) Inventor: Georg Zingerle, Schabs (IT)

(73) Assignee: Zingerle AG, Natz/Schabs (IT)

( * ) Notice: Subject to any disclaimer, the term of this patent is extended or adjusted under 35 U.S.C. 154(b) by 0 days.

(21) Appl. No.: 16/054,260

(22) Filed: Aug. 3, 2018

(65) Prior Publication Data

US 2019/0040649 A1 Feb. 7, 2019

(30) Foreign Application Priority Data

Aug. 4, 2017 (DE) ..... 10 2017 117 777
Aug. 4, 2017 (DE) ..... 20 2017 105 101 U

(51) Int. Cl.
*E04H 15/32* (2006.01)
*E04H 15/64* (2006.01)
*E04H 15/50* (2006.01)

(52) U.S. Cl.
CPC ..... *E04H 15/322* (2013.01); *E04H 15/50* (2013.01); *E04H 15/64* (2013.01)

(58) Field of Classification Search
CPC ..... E04H 15/322; E04H 15/50; E04H 15/64
See application file for complete search history.

(56) References Cited

U.S. PATENT DOCUMENTS 5,335,685 A * 8/1994 Dahulich ..... E04H 15/322 135/118
6,814,094 B1 * 11/2004 Barber ..... E04H 15/322 135/119
6,874,518 B2 * 4/2005 Porter ..... E04H 15/46 135/119
6,877,261 B2 * 4/2005 Milton ..... E04H 15/322 38/102.8
9,340,995 B2 * 5/2016 Jin ..... E04H 15/46
2007/0028953 A1 * 2/2007 Zanot ..... E04H 15/64 135/119
2007/0240746 A1 * 10/2007 Chen ..... E04H 15/322 135/119
2014/0261599 A1 * 9/2014 Arbeiter ..... E04H 15/322 135/121

* cited by examiner

*Primary Examiner* — Noah Chandler Hawk
(74) *Attorney, Agent, or Firm* — Tucker Ellis LLP; Michael G. Craig

(57) ABSTRACT

Device for tensioning a fabric of a tent comprising a tensioning device, a corner protection device as well as a fastening element, wherein the tensioning device (9) presses against at least one tensioning element (6) of the corner protection device (5), on which the fabric of the tent (1, 12) can be arranged, wherein a fastening element (7) is arranged on the lower part (59) of the corner protection device (5).

21 Claims, 22 Drawing Sheets

DEVICE FOR TENSIONING A FABRIC OF A TENT

RELATED DOCUMENTS

This application claims priority to German Patent Application No. 10 2017 117 777.9, filed Aug. 4, 2017, and titled DEVICE FOR THE VOLTAGE OF A FABRIC OF A TENT, and claims priority to German Patent Application No. 20 2017 105 101.3, filed Aug. 4, 2017, registered on Sep. 6, 2017, and titled DEVICE FOR THE VOLTAGE OF A FABRIC OF A TENT, all of which are incorporated by reference in their entirety.

BACKGROUND

The present invention relates to a device for tensioning a fabric of a tent comprising a tensioning device, a corner protection device as well as a fastening element according to claim 1.

A tent is usually understood to be a temporary, simple and preferably portable construction comprising a framework of poles and a roof placed above it. Today, aluminum poles are mainly used for the framework of poles, but other metal and plastic materials or wood can also be used.

In recent times, so-called folding tents, which are also referred to as quick pitch tents, have become more and more important. Their advantage lies in the fact that they are mainly delivered with the roof already assembled, that it is not necessary to dismantle the roof when setting up and taking down the folding tent, and that the setting up and dismantling can usually also be carried out without tools.

Such folding tents are folded in the delivery state. When the tent is set up, a structure opens up as a result of the tent being pulled apart, and the pre-assembled roof is tensioned automatically. For this purpose, the supports of the tent are connected to a roof structure having the shape of a scissor-type grid, which enables the tent to be pulled apart when being set up.

Regardless of the respective configuration of a tent, the tent roof usually rests on the ends of the supports that are at the top in the set-up state and spans them. The tent roof often ends with a screen running around the upper areas of the supporting structure. A synonym for the term "screen" is, for example, "valance" and is also covered by the present invention.

The connection between the tent roof and the supporting structure is usually tight when the tent is new, which leads to the desired tensioned state of the tent roof. On the other hand, the tensioned state of the connection between the tent roof and the supporting structure often leads to permanent friction of the tent roof fabric on this supporting structure, which can be accompanied by damage and even tearing of the fabric, in particular at these contact points after prolonged use.

On the other hand, it should be noted that the fabric of the tent roof expands when the tent is set up for a longer period of time, for example due to weather conditions or fatigue of material, and thus no longer fits accurately on the supporting structure of the tent. As a consequence, the tent roof itself does no longer maintain the desired smooth, tensioned state, but is loose, wavy and generally no longer well-fitting. This has not only visual disadvantages, but also disadvantages in terms of effect, since, for example, the wind is more easily caught in it and both the tent roof fabric and the supporting structure are thus subjected to additional loads.

In order to protect the tent roof fabric from friction or to protect the screen of a tent from getting caught in the supporting structure of the tent in the folded and in the extended state, a corner protection device has been proposed according to the German utility model DE 20 2004 016 428 U1, which is arranged on the part of the supports of the tent that is at the top of these supports in the set-up state and which leaves a gap open between itself and this support, into which the screen of the fabric of the tent roof is inserted and fastened in a manner described in more detail below.

With this device known from the state of the art, however, it is not possible to ensure a permanent tension of the tent roof in the set-up state of the tent if, in the course of time or in the course of use of the tent, an expansion of the fabric occurs, for example due to material fatigue.

There are indeed numerous efforts in the state of the art to tension fabrics permanently in the most diverse fields of application. Such efforts take place on a large scale in the field of manufacturing folding tops for convertible cars. Highly complex constructions have been developed for this purpose, as are described, for example, in EP 1 314 601 B1, but all of them are limited to these specific fields of application and cannot be transferred to other fields.

Based on these drawbacks of the state of the art, the technical problem is therefore to provide a device for tents which, on the one hand, protects the fabric of the tent roof in the set-up state from damage due to friction.

In addition, a device is to be developed which allows a visually and functionally good fit of the tent roof on the supporting structure of the tent.

Furthermore, the device should allow a perfect fit of the tent roof on the supporting structure to be maintained for the entire duration of use.

In addition, this device should comprise a simple construction that can be manufactured in a cost-effective manner. The construction should be made of a few parts and therefore be lightweight.

Furthermore, the device should be configured in such a manner that it is suitable for folding tents, i.e. it is already integrated in the delivery state after manufacture so that no further handling steps or assembly steps on the part of the user are necessary.

In addition, the device should be suitable for all types of tents.

These problems are solved with a device according to claims 1, 20, 21. Advantageous embodiments are included in the sub-claims.

SUMMARY

According to an invention, a device is provided which serves to tension a fabric of a tent and which has a tensioning device, a corner protection device as well as a fastening element, wherein the tensioning device presses against at least one tensioning element of the corner protection device, on which the fabric of the tent can be arranged, wherein a corner bracket is arranged at the lower end of the corner protection device.

Tent within the meaning of the present application is understood to be any type of tent, in particular a folding tent, a party tent, a market stand, a pavilion, a folding pavilion, a trade fair stand, a kiosk, a medical tent, an accommodation tent, a kitchen tent and a command tent.

Fabric of the tent, in particular the tent roof, is understood to be any material used for tents, for example reinforced vinyl, cloth, polyester, PVC, nylon, polyurethane, impregnated fabrics, plastic foils or mixed fabrics.

The tent has an internal supporting structure, i.e. a framework. This framework comprises a number of supports, which are preferably set up at the respective end areas of a tent. Depending on the geometrical configuration of the tent, the framework comprises at least three supports. In the case of a rectangular or square tent, the tent has at least four supports. A polygonal tent has a corresponding plurality of supports.

As a synonym for the term "support" used here, the terms "support leg", "corner post" or the like can also be used.

The supports in turn can be arranged on the bottom side in separate feet, which is particularly suitable when setting up a tent on a lawn, the ground, sand, concrete, slabs or the like.

The material of the supports can comprise wood, bamboo, plastic or metal. It is preferred that aluminum is used for the supports.

The geometrical configuration of the support is basically of no importance. Within the scope of the present invention, an octagonal configuration of a support in the form of a hollow profile is assumed merely by way of example, i.e. without being limited thereto. The outer wall of the support can be smooth, ribbed, corrugated or have any other desired configuration.

The roof structure of the tent rests on the end of the supports that is at the top in the set-up state of the tent. In the case of a square tent structure, the four respective corner areas of the tent roof are thus disposed on the supports correspondingly arranged in a square. A connection between the supports and the corner areas of the tent roof is preferably made in the form of a hinged connection. However, the latter is not the subject matter of the present invention.

The upper area of the support can be provided with a cover in the direction of the corner area of the tent roof Beneath this cover, if any, the tensioning device according to the invention is arranged, which is disposed above the end of the support in one embodiment. The tensioning device is thus located between the cover and the upper end of the support. It can be fastened in various ways, for example placed on the end piece of the support by means of a connector protruding downwards and fastened in any way.

In another embodiment, the tensioning device according to the invention is arranged inside the upper end of the support, which is configured in the form of a hollow body. In this embodiment, too, the tensioning device is located beneath the cover.

The tent roof arranged above the upper end of the support and above the cover overlaps the upper part of the respective support as well as the tensioning device on its respective outer side. For this purpose, the tent roof preferably has a screen.

The overlapping of the tent roof, in particular by means of the screen, is preferably carried out with an accurate fit so that there is a tight contact between this part of the tent roof and the outer peripheral side of the upper part of the support and the outer peripheral side of the tensioning device. However, a corner protection device is inserted between this part of the support and the encompassing fabric, as described in detail below.

Due to the configuration and functional principle of the tensioning device described below, which interacts with the corner protection device—as described in detail below—, a permanent tensioning effect on the tent roof is provided in the set-up state, thereby compensating for the expansion of the fabric material of the tent roof during the entire set-up of the tent, which may occur over the course of time and through use, for example due to material fatigue.

According to the invention, the arrangement of a so-called corner protection device, which could also be more precisely described as an edge protection device, is also provided for. However, since it is referred to as such in the state of the art, this term should also be used here.

The corner protection device comprises an elongated body, which, as will have to be explained in more detail below, is partially movable. This elongated body can have a round or angular configuration towards its inner side and—in the case of an angular configuration—at least two segments that are elongated in the longitudinal direction. With the inner side of this body, the corner protection device is fastened to the upper part of the support. For this purpose, the inner side of this body may be configured in a manner that fully or approximately corresponds to the contours of the outer side of the support.

The length of the corner protection device preferably corresponds to the width (height) of the screen of the tent roof.

The corner protection device has thus a three-dimensional structure and an overall shell-shaped configuration. The shell-shaped configuration encompasses the outer side of the support with the inner side of the corner protection device.

Of course, the corner protection device can, for example, have a semicircular or three-quarter-circular, an oval or rectangular design. In this respect, any design of the corner protection device, which is preferably adapted to the outer shape of the support, is possible.

In the case of an octagonal configuration of the support with four narrower end faces, the support of the corner protection device may therefore have an approximately semicircular configuration or three segments provided at angles to each other. This means that the body of the corner protection connector can, for example, be fastened to one of the narrow end faces or longer sides of the octagonal support.

The fastening is carried out by means of a rivet, which is inserted into a recess of the corner protection device and which penetrates the latter at a corresponding location of the support and ends there at a rivet counter-holder. Of course, other types of fastening, for example by means of screws or by welding or adhesive bonding, are also possible.

The recess for the rivet is located in a hinge section of the body of the corner protection device, which can be arranged in the longitudinal as well as in the transverse direction approximately in middle of the body of the corner protection device.

This hinge section has the effect that the corner protection device is not rigid in its entirety, but has two sections, at least one of which is configured so as to be movable.

For this purpose, the hinge section of the corner protection device has at least one notch, which can only be a groove-shaped indentation, for example. Notch and groove-shaped indentation are therefore understood as synonyms. In this area, the body of the corner protection device can thus perform a slight buckling movement or bending movement.

In order to provide the support of the corner protection device with sufficient stability in this area of the hinge section in spite of this notch, it may have at least one reinforcing ring or at least one reinforcing rib above and below the recess for the rivet in the transverse direction.

The term "hinge section" within the meaning of the present invention does not only mean the embodiment described above. Rather, this term also covers other embodiments, which are at the discretion of the person skilled in the art, in order to solve the present technical problem by means of a connection between the functional parts of the corner protection device. The term therefore also covers other movable connections between two parts, for example swivel joint (also articulated joint or hinge, piano hinge, film hinge), screw joint, turn-slide cylindrical joint, plate joint, ball joint or other moment joint connections.

In order to ensure this flexibility of the corner protection device, it is made of any material suitable for this purpose, which, on the one hand, is strong enough to fulfil the function of the corner protection device to avoid unnecessary friction between the fabric of the screen of the tent roof and the support and which, on the other hand, is soft enough and flexible enough to perform a bending or buckling movement in its upper area to such an extent that the above-described expansion of the material of the tent roof as a result of time and use can be compensated for. This means that the material must also have a certain stability.

For this purpose, the corner protection device can be made of an appropriate stable but also flexible plastic material or an appropriate metal material.

The part of the corner protection device that is at the top as viewed in the longitudinal direction and when the tent is set up is thus configured in the form of a flexible tensioning element. This tensioning element is operatively connected to the tensioning device in a manner to be described in more detail below.

The lower part of the corner protection device preferably abuts on the support and thus cannot be moved away from it. It is therefore not referred to as tensioning element. This lower part of the corner protection device has no tensioning function in this configuration.

For this purpose, the length of the body of the corner protection device is such that it protrudes laterally beyond the upper end of the support of the tent roof where the one embodiment in which the tensioning device is arranged above the upper part of the support is concerned.

For this purpose, the tensioning element also has a spatial-geometrical enlargement at its upper end. This enlargement can either be made of the same material as the support of the tensioning element or the corner protection device or can comprise a different material. This enlargement is referred to below as tensioning element head and thus describes a configuration of this component.

The spatial-geometrical enlargement of the tensioning element head is directed towards the tensioning device in order to establish contact between the element of the tensioning device described below and the tensioning element head for the purpose of enabling the tensioning of the fabric of the tent roof.

As already explained above, the tensioning device is arranged above the end of the support. The tensioning device preferably has a housing, which can be attached to the upper end of the support, for example via a downward extension of its outer sides in the dimension of the extension. This creates a connection between the housing of the tensioning device and the upper end of the support. The connection can be form-fit and/or friction-fit or force-fit; in addition, it can be supported by a screw connection, riveting or the like.

Inside the housing of the tensioning device, there is a recess, which is preferably elongated in the horizontal direction. In this recess, a spring is mounted, which is in contact with a pressure element.

Preferably, this is a pressure spring made of stainless and spring steel. Such a cylindrical coil spring is usually made of round wires with a constant diameter. The pitch is constant along the spring axis, with the left and right end coils being closed. The pressure spring has a linear characteristic, and mainly the spring axis is stressed.

Instead of such a conventional pressure spring, other components can also be used which fulfil the function according to the invention.

For example, disc springs can be used. They are compact and, at the same time, transmit high forces. By arranging more than one disc spring one above the other, both the force and the spring travel can be multiplied.

In addition, elastomer springs can be used, which are characterized by a long service life, defined spring characteristics even after long use, abrasion resistance, high elongation at fracture, security against fracture and material damping.

According to the invention, these different components are referred to as springs; for reasons of simplification, however, (pressure) springs are assumed in the description of this invention.

There is no need to explain in more detail that instead of one spring, it is also possible to use a plurality of springs side by side or one below the other. This results in a more even and hence more gentle distribution of pressure on the tensioning element. Such an exemplary embodiment is described further below in connection with the discussion of a third embodiment, but applies equally to all embodiments.

Due to the spring force, this pressure element is pressed against the tensioning element head of the corner protection device arranged on the outer side of the tensioning device.

For this purpose, the spring can overlap the pressure element or, for example, be arranged in front of the end face of the pressure element and act on this end face.

In one exemplary embodiment, the pressure element has a bead-like or annular projection, which creates the contact surface with one end of the pressure spring overlapping the pressure element. This means that the pressure spring acts on this bead or ring with its force and thus pushes the pressure element against the tensioning element head.

In one embodiment, the pressure element is configured in the form of a bolt.

Due to the fact that the fabric of the tent roof, in particular in the form of a screen, runs downwards on the outer side of the tensioning element or the corner protection device, it also abuts on the outer side of the tensioning element head.

By pressing the spring of the tensioning device against the tensioning element head, the tensioning element is pressed against the fabric of the tent roof. To the extent that the fabric of the tent roof is expanded, the aforementioned construction thus keeps the tent roof permanently under tension so that the desired effect of a permanent tension of the tent roof as a whole is made possible.

However, in order to prevent this effect from being at least partially cancelled out by the tent roof evading the tensioning pressure built up, a fastening element is mounted in the lower area of the corner protection device. The fastening element within the meaning of the present invention can also be a corner bracket, a corner clip, a ring, a tape, a chain, a frame, a connector, a cross connector, a fastening clip, a clamp, a snap fastener, a snap fastener with a barbed hook or the like. For reasons of simplification, the fastening element is also referred to below as corner bracket.

This fastening element is mounted on the outer side of the lower part of the corner protection device.

In addition, the corner bracket is connected to the corner protection device of the tent roof. For these purposes, the corner bracket may have a push-in part on its inner side, for example a push-in clip, which passes through a corresponding opening in the lower part of the corner protection device so that a connection to the corner bracket is established.

For this purpose, the corner bracket can, for example, also have a spring-loaded push-in part, which is provided with a kind of barbed hook, which hooks on the inner wall of the corner protection device after it has been inserted through the opening.

Instead of such a configuration, other connections can also be created, for example by means of rivets, screws, Velcro or the like.

In order to achieve the function of counter-tensioning the fabric of the tent roof described above, it is essential that there is a sufficiently large clearance between the corner bracket and the outer side of the corner protection device, which serves to receive the fabric of the tent roof.

It is particularly advantageous if the fabric web end of the tent roof fabric has an eye-shaped opening in the area of the aforementioned push-in part of the corner bracket, through which the push-in part can also be inserted so that a fastening of the fabric web remains ensured even in the event of jerky movements of the tent roof, for example due to the action of wind.

Insofar as it has been described in the above explanations that the fabric web of the tent roof is guided past the outer side of the upper part of the support, this is to be specified according to the explanations in such a way that the corner protection device with its tensioning element is arranged between the outer side of the upper part of the support and the inner side of the fabric so that a kind of sandwich-like structure of the support, the fabric web and the corner protection device is formed in in this area.

On the one hand, the aforementioned design features therefore ensure that the end of the fabric of the tent roof, in particular the screen, can be guided across the outer side of the corner protection device and thus across the supports in a manner that is gentle on the material. On the other hand, the configuration of the corner protection device in the form of a tensioning element in conjunction with the tensioning device and in conjunction with the fastening element, which is advantageously configured in the form of a corner bracket or a corner clip, ensures that, in addition to guiding the fabric of the tent roof in a manner that is gentle on the material, a permanent tension of the fabric is also achieved, which compensates for material expansions occurring to the corresponding extent.

As far as the fastening element described above is concerned, it can also be configured in the form of a flat, rectangular plastic part, which can be sewn onto the inner side of the tent roof, in particular to the inner side of the screen of the tent roof. Instead of sewing on, other fastenings can also be selected, for example by means of rivets, screw connections, Velcro connections, zips, snap fasteners or the like.

In this further embodiment, the sewable/sewn-on plastic part is connected to the lower part of the corner protection device on its side facing away from the fabric of the tent roof In this embodiment, this connection of the fastening element can be made in any suitable way. In particular, it can be made in such a way that the plastic part has a hook corner clip approximately in the center, which can be inserted through a corresponding opening into the lower part of the corner protection device and which hooks there on the inner side of the lower part of the corner protection device. For this purpose, the hook corner clip preferably has snap-in counter-latches.

Such a hook corner clip can be formed a separate part on the plastic part, but it can also be made of the plastic part material itself and can, for example, be inserted from the plane of the surface of the plastic part into the complementary opening of the lower part of the corner protection device by punching and bending.

Last but not least, it is advantageous in this latter case if the material thickness of the plastic part is different, i.e. it is stronger, more tensile and more stable at the point where the connection to the corner protection device is made than at the point where it is sewn onto the fabric of the tent roof.

In a preferred configuration of the further embodiment of the fastening element described above, the plastic part has a tongue-like projection on its side which, when sewn on, is located at the bottom and which encompasses the lower end face of the lower part of the corner protection device so that further stabilization of the fastening between the tent roof and the corner protection device occurs.

In this further embodiment of the fastening element described above, a sandwich-like structure of the corner protection device, the fastening element and the fabric of the tent roof is thus created.

In another embodiment according to the invention, a tensioning device is also used, which implements the design principles described above and which interacts in the same way with the corner protection device described above and the tensioning element, but which differs from the embodiment described above in that it is inserted into the hollow body of the support.

In this case, the tensioning device either uses the internal space of the support as a housing, within which this embodiment is used, or the tensioning device is located inside an insert, which is inserted, for example pushed, into the hollow space of the support.

However, it is also possible to insert the tensioning device as a kind of push-in part between two separate parts of the support and to connect the supports to each other indirectly via the tensioning device in this way.

In this embodiment, a corresponding opening is provided in the support, through which at least one spring of the tensioning device presses against the tensioning element of the corner protection device in a manner as has been explained in connection with the first-mentioned embodiment.

If the tensioning device is arranged inside the hollow body of the support, it is not necessary for the length of the body of the corner protection device to protrude laterally beyond the upper end of the support of the tent roof In a third embodiment, the tensioning device is an integral component of the corner protection device.

It is a device for tensioning a fabric of a tent comprising a tensioning device, a corner protection device as well as a fastening element, wherein the tensioning device can be guided through an opening of the corner protection device, on which the fabric of the tent can be arranged, wherein a fastening element is arranged on the lower part of the corner protection device.

The corner protection device is fastened to the support in a manner appropriate in terms of construction, as has been explained for the embodiments described above.

At its lower end, the corner bracket for the fabric of the tent roof is arranged in basically the same way. The overall disclosure of the configuration of the corner bracket, its arrangement and fastening to the corner protection device, the configuration of the corner protection device and its arrangement and fastening to the support of the tent with respect to the first configuration applies equally to this embodiment.

However, this third embodiment differs from the two other embodiments in that the tensioning device is no longer a direct structural component of the support of the tent, but part of the corner protection device itself.

The corner protection device is attached and fastened to the support of the tent in the same way, as has been described with regard to the first embodiment. At its lower end, a corner bracket is attached to the corner protection device, as has been described for the first embodiment. The overall content of disclosure in this respect therefore also applies to the third embodiment.

At the point where the screen of the tent fabric overlaps the corner protection device, an opening is provided in the corner protection device, which receives the tensioning device. For this purpose, the tensioning device is preferably arranged on the inner side of the corner protection device, hence adjacent to the outer side of the support. This can be achieved by using conventional fastening measures. For example, the tensioning device can be screwed, riveted, glued or the like to the inner side of the corner protection device; in particular, it can be fastened to a plate, which in turn is fastened to the inner side of the corner protection device.

The tensioning device can preferably be guided through the opening in the corner protection device in the direction of the fabric of the tent roof. The opening can preferably have a rectangular or elongated configuration so that more than one spring of the tensioning device can pass through it. If a plurality of springs is used, a more even distribution of pressure on the fabric of the tent roof, which overlaps the corner protection device in this area, is achieved in this way.

For example, five springs are arranged side by side in one exemplary embodiment. The springs are arranged in an analogous manner on one side thereof in the tensioning device and end at their other end, which is directed towards the fabric web, in corresponding pot-shaped receptacles, which serve to hold these ends of the springs and which in turn are arranged in a tensioning shell. This tensioning shell is thus open towards the springs, while it has a smooth, closed surface towards the fabric of the tent roof.

The springs thus press into the pot-shaped receptacles of the tensioning shell, which in this way presses with its smooth, closed surface against the screen of the fabric of the tent roof. This results in a visually even tension of the fabric of the tent roof In summary, the functional principle can be described in such a way that the springs together with the tensioning shell are more or less retracted in the corner protection device in their original state and thus create a smooth surface of the corner protection device in the area of its opening. If the fabric of the tent roof expands, the springs with the tensioning shell extend out of their holder and press against the fabric of the tent roof, thereby causing it to be permanently and evenly tensioned.

The force which the springs have to exert in all three embodiments in order to achieve the tensioning effect essentially depends on the type of tent and the fabric of the tent and can be easily determined by manual testing. Without there being any restriction in this respect regarding specifications, it has been shown that approximately 150 N up to 300 N are a good basis for the selection of the springs and the determination of the force to be applied.

In this third embodiment, it is clear that the corner protection device itself does not have to be configured so as to be partially movable, as has been described, for example, for the previous embodiments, because it is not the corner protection device itself which moves against the fabric web of the tent as a result of the pressure of the springs, but because this function is performed by the configuration of the springs with the tensioning shell described above.

Therefore, the corner protection device does not need to have an appropriate hinge arrangement, by means of which the upper part of the corner protection device is configured in the form of a tensioning element so as to be movable. In the third embodiment, the corner protection device can thus have an even structure and fabric configuration.

Of course, this does not exclude the possibility that the corner protection device may have one or more reinforcing elements, for example reinforcing ribs, in order to increase its stability, in particular on its inner side.

BRIEF DESCRIPTION OF THE DRAWINGS

For a better understanding of the present invention, reference is made exclusively for the purpose of exemplary illustration and without any restrictive effect to the figures below, which show the following:

in FIG. 7A the tensioning device is "retracted", whereas in FIG. 7B it is "extended";

FIG. 11-FIG. 15 the third embodiment, wherein

FIG. 11 shows the corner protection device with the "extended" tensioning device, and FIG. 12 shows the corner protection device with the "retracted" tensioning device;

FIG. 13 the tensioning shell;

FIG. 14 the opening for the tensioning device in the corner protection device;

FIG. 15 the opening for the tensioning device covered by means of the tensioning shell as well as the corner protection device;

FIG. 16A-E a further embodiment of the fastening element, wherein FIG. 16A is an overall view, FIG. 16B and FIG. 16C are interior views and FIG. 16D and FIG. 16E are detailed views.

DETAILED DESCRIPTION

Figure 1A:
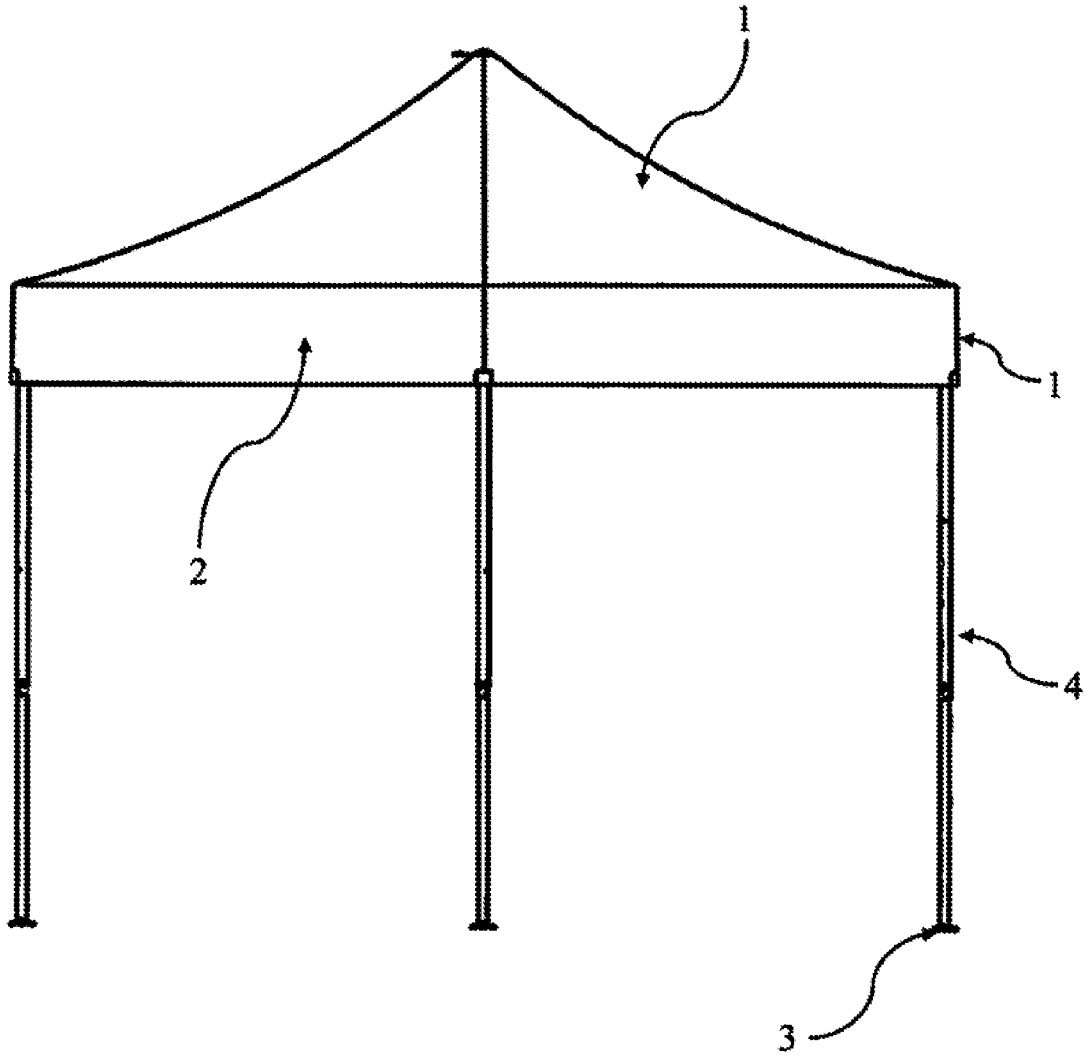
FIG. 1A a schematic diagram of a tent with a tent roof in diagonal view.
Figure 1B:
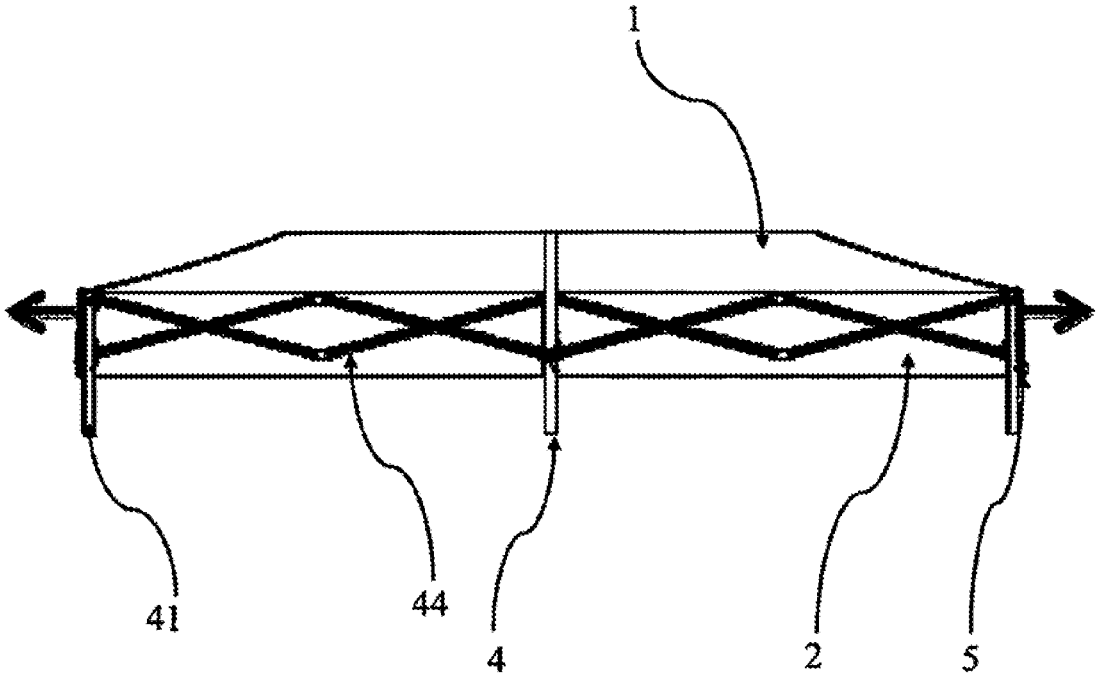
FIG. 1B a schematic diagram of the roof structure having the shape of a scissor-type grid with an overlapping screen of the tent roof fabric.

FIG. 1A shows a schematic diagram of a rectangular, in particular square tent in diagonal view; FIG. 1B shows a kind of X-ray view of the area of the tent roof which is "behind" the screen 2. The tent roof 1 has a screen 2. At the respective end areas of the tent roof, the screen 2 overlaps the upper end 41 of the supports 4, which in turn are arranged in feet 3. The supports 4 are connected to the roof structure 44 having the shape of a scissor-type grid, which supports the roof of the tent. In addition, the corner protection device 5 in the area of the upper end 41 of the supports 4 is illustrated schematically. The arrows pointing to the left and to the right already indicate that the tension of the tent roof described in more detail with respect to FIG. 3 to FIG. 9 goes in the direction of the arrows.

Figure 2:
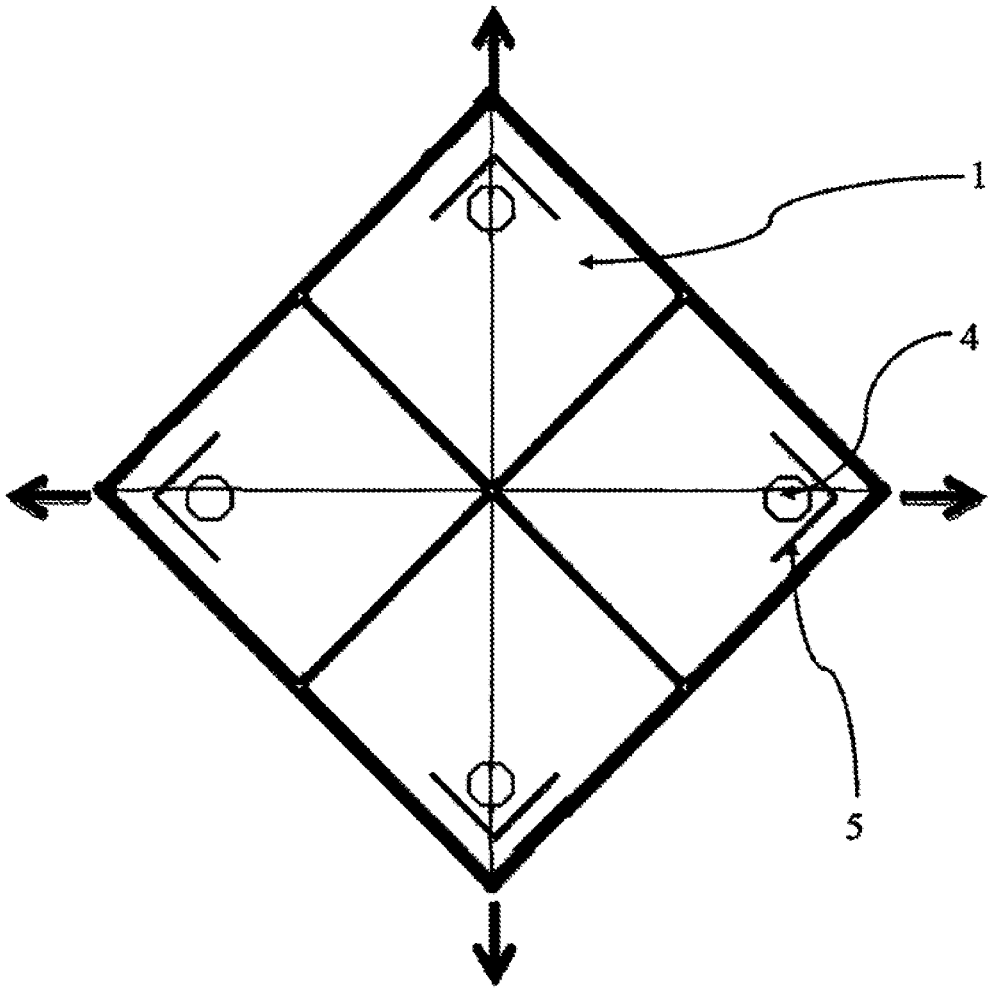
FIG. 2 a schematic diagram of a tent roof in plan view.

FIG. 2 shows a schematic diagram of the tent roof illustrated in FIG. 1 in plan view. In all four corners of the tent roof 1, supports 4 are arranged, which have a corner protection device 5. The corner protection device 5 is arranged between the fabric of the tent roof and the support 4. The arrows displayed in all four corners indicate the direction of the tensioning effect achieved by the invention.

Figure 3:
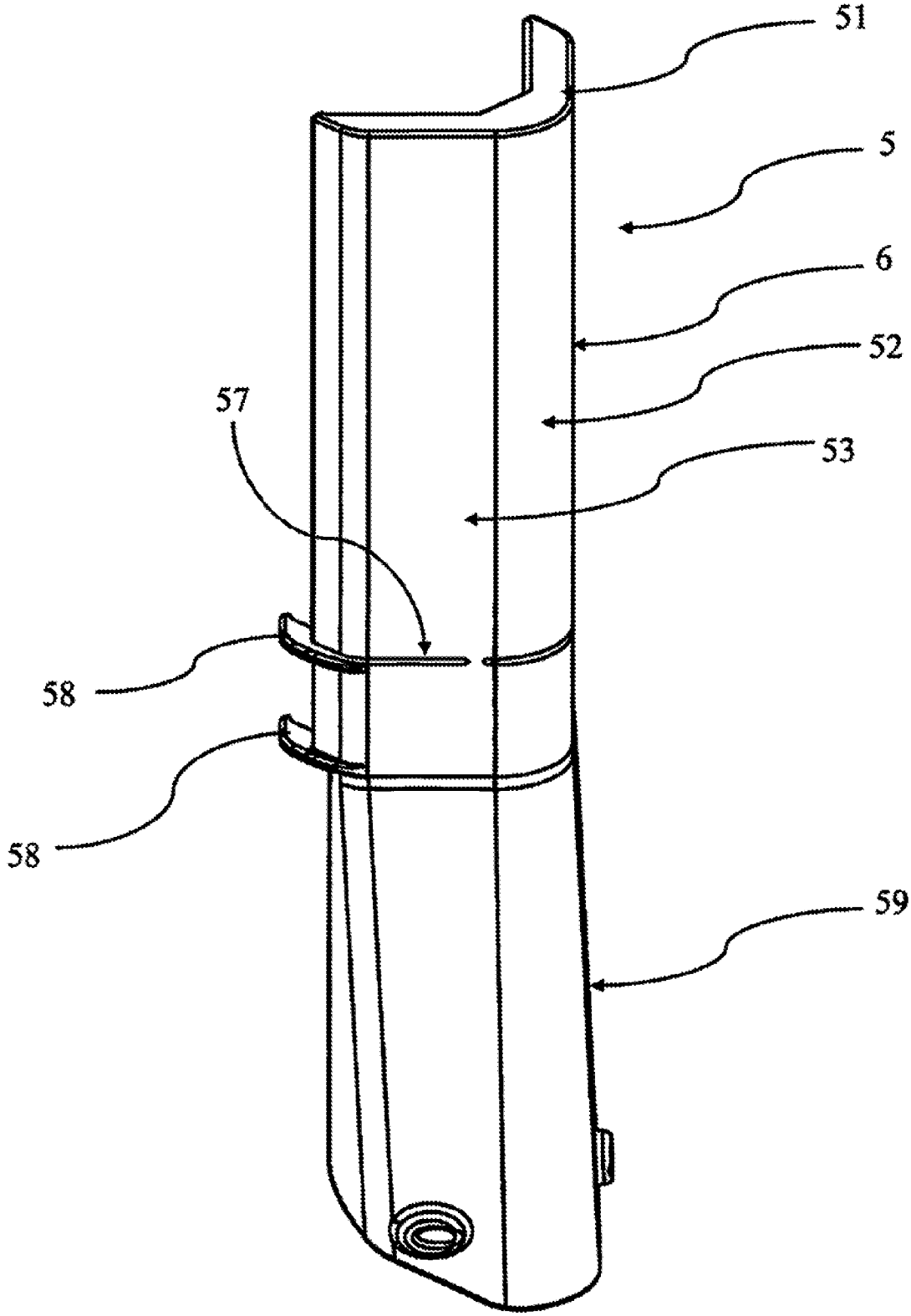
FIG. 3 a three-dimensional schematic diagram of the corner protection device.
Figure 4:
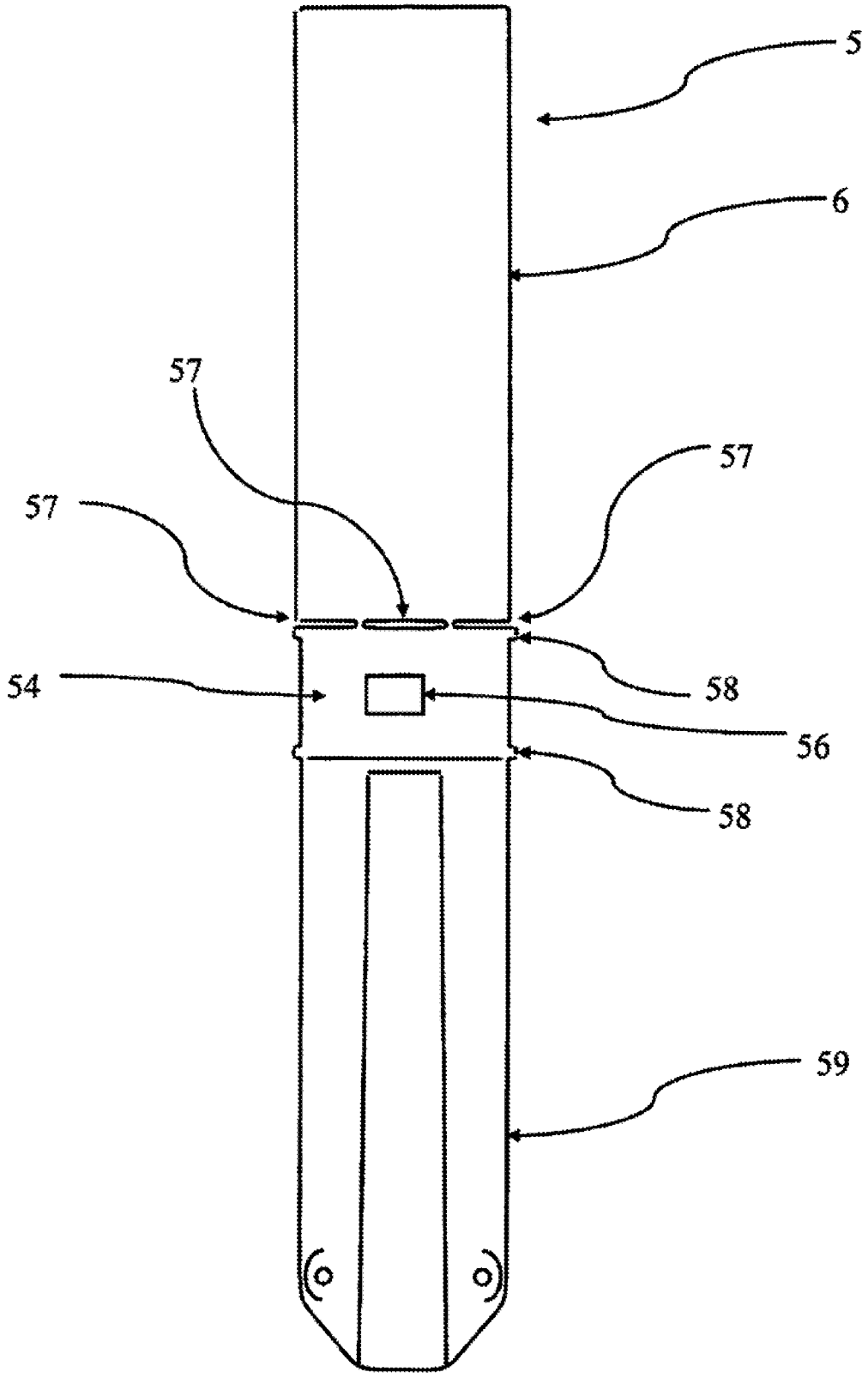
FIG. 4 a diagram of the corner protection device configured in the form of a tensioning element in front view.
Figure 5:
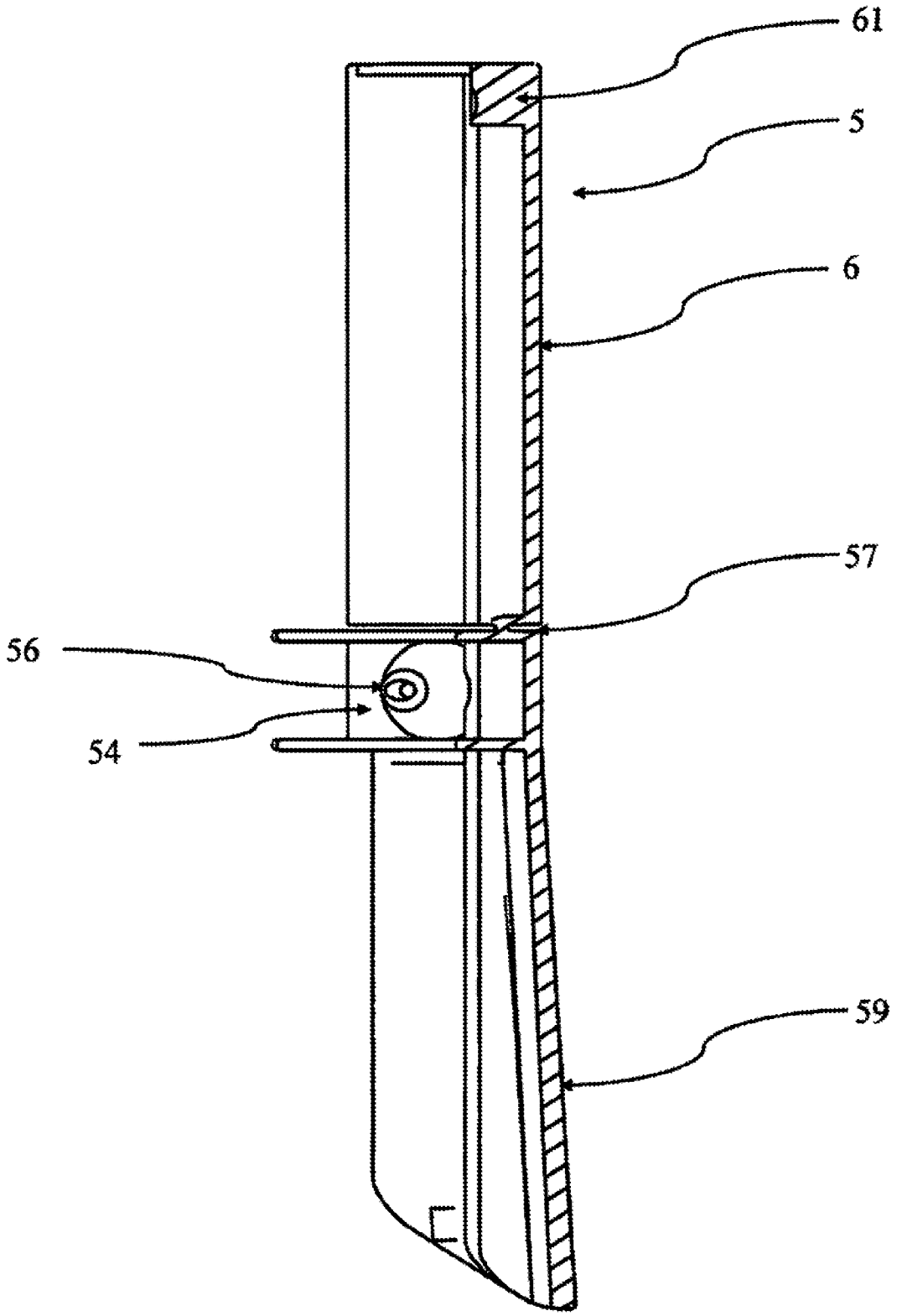
FIG. 5 the tensioning device with the tensioning element in sectional view.

FIG. 3 to FIG. 5 show as schematic diagrams the structure of the corner protection device 5, which, in the diagram shown, also serves as a tensioning element 6 according to the first and second embodiment.

FIG. 3 reveals the three-dimensionality of the corner protection device 5. The corner protection device 5 has a body comprising three essential areas. The corner protection device 5 has an overall shell-shaped configuration. In the shell-shaped configuration shown, the corner protection device 5 encompasses with its inner side the outer side of the support 4, which is illustrated in more detail in FIG. 7 and FIG. 8.

It can be seen in the upper part of the corner protection device 5 according to FIG. 3 that it is configured there in the form of a tensioning element 6. The corner protection device has an outer side 49 and an inner side 50, but in this exemplary embodiment, the corner protection device has three elongated, vertically running segments 51, 52 and 53. The segments 51, 52 and 53 can form a unit in terms of material and design, but can also be separated in a slot-like manner. In the aforementioned shell-shaped configuration of the corner protection device 5, these segments are arranged—when viewed from above—roughly in the form of a boomerang to one another, i.e. an approximately arc-shaped course of the corner protection device can be seen, with segment 52 showing the end face of this element, while the segments 51 and 53 are arranged laterally thereof.

According to FIG. 3, this upper area of the corner protection device 5 is interrupted—when viewed vertically—approximately in its center by a hinge section 54, which has at least one notch 57. This configuration of the hinge section with the notch 57 ensures that the upper part of the corner protection device 5, which is configured in the form of the tensioning element 6 so as to be movable, can thus be moved in a predetermined and suitable manner towards the outer side of the upper part 41 of the support 4 not shown in FIG. 3 or can be moved away from this outer side as a result of the hinge section 54.

Since the notch 57, in particular, causes a material weakening of the overall corner protection device, this component provides at least one reinforcing rib 55 for the internal connection to the support 4, 41 or a reinforcing ring 58 as compensation.

In addition, FIG. 3 shows the lower part 59 of the corner protection device 5. As can also be seen in FIG. 6, FIG. 7A and FIG. 7B as well as FIGS. 16A, B, C, it receives the fastening element 7, or the latter is arranged in area 59 on the corner protection device 5. The part 59 is not movable towards or away from the support 4, 41.

Furthermore, FIG. 4 shows the aforementioned illustration in front view. The corner protection device 5 can be seen together with the tensioning element 6. In addition, it can be seen that the hinge arrangement 54 has three notches 57 and two reinforcement rings 58 in this exemplary embodiment. In the center of the hinge section 54, a recess 56 for receiving a rivet can be seen. By means of this rivet, the corner protection device 5 is connected to the upper part 41 of the support 4 of the tent roof 1. For this purpose, the upper part 41 of the support 4 has an opening at the corresponding point of the recess 56, through which the rivet can pass and is firmly connected to the inner side of the hollow support 4 in a manner customary in riveting technology.

FIG. 4 also shows the lower part 59 of the corner protection device 5.

The corner protection device 5 is also shown in FIG. 5 in side view. Above the hinge section 54, the provided tensioning element 6 can be seen, which merges into a spatial-geometrical enlargement at its upper end, namely into the tensioning element head 61. This tensioning element head 61 is shown in more detail in FIG. 7A, FIG. 7B and FIG. 9 in its interaction with the tensioning device 9.

The hinge arrangement 54 with the recess 56 for a rivet can again be seen beneath the tensioning element area 6. The lower part 59 of the corner protection device 5 runs beneath it.

Figure 6:
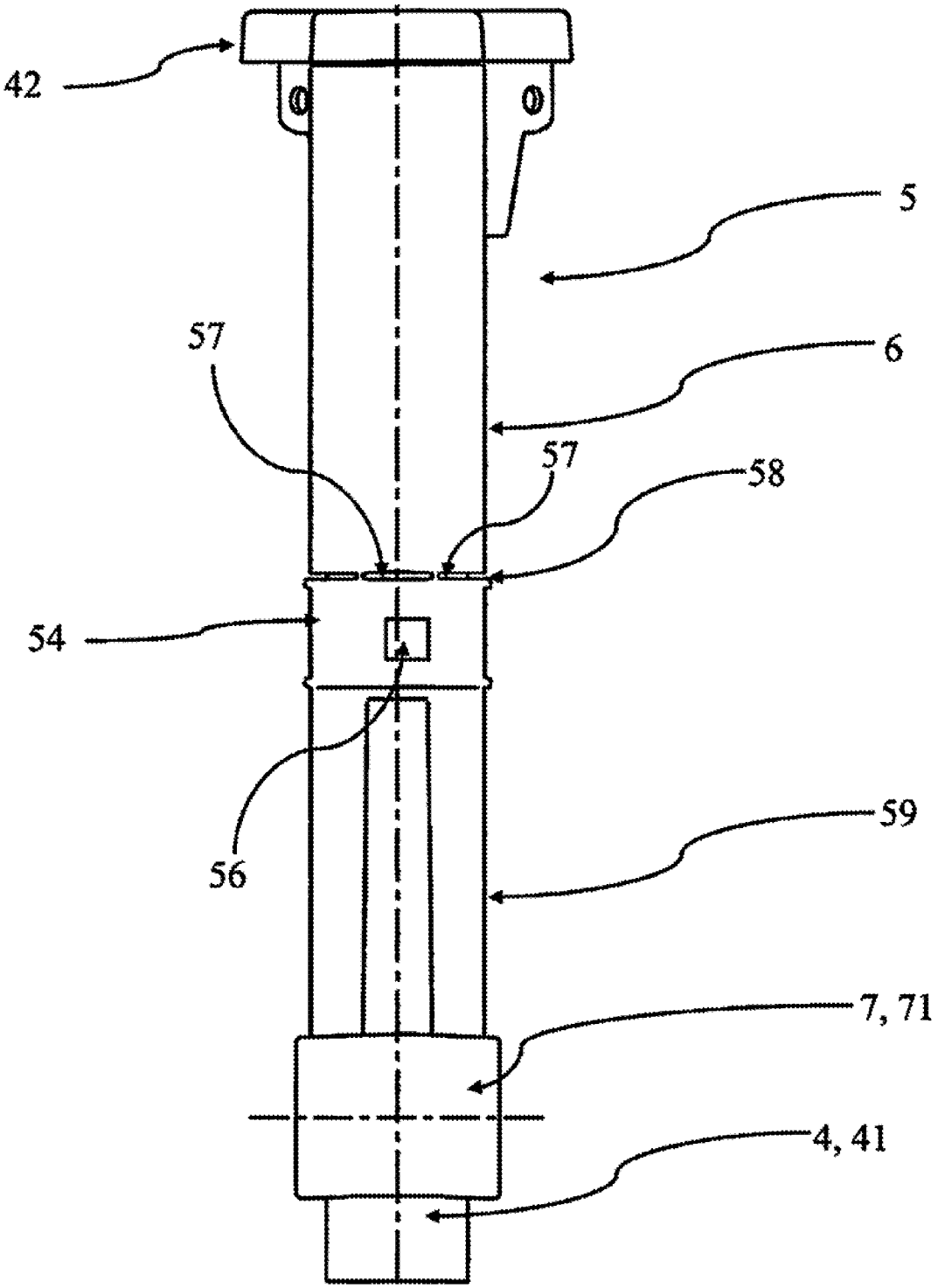
FIG. 6 a schematic diagram of the upper support with the corner protection device attached comprising a tensioning element and an attached fastening element.

FIG. 6 shows a schematic diagram of the arrangement of the corner protection device 5 arranged on the upper part 41 of the support 4 in front view.

FIG. 6 shows the presence of a cover 42, by means of which the tensioning device 9 is protected from weather influences and dirt. In FIG. 6, the tensioning device 9 is covered due to the concealed view of the corner protection device 5; the arrangement of the tensioning device 9 beneath the cover 42 can be seen in side view in FIG. 7A and FIG. 7B.

It can also be seen in FIG. 6 that the corner protection device 5 has a tensioning element 6. In the area of the hinge section 54, three notches 57 can again be seen, which are also marked in FIG. 5 in the side view of the corner protection device.

The hinge section 54 is also marked in FIG. 6 by two reinforcement rings 58 shown.

The lower part 59 of the corner protection device 5 also receives the fastening element 7, which can be recognized as a corner bracket 71 in the concrete illustration. It can also be seen that the corner protection device 5 is arranged vertically on the outer side of the upper area 41 of the support 4.

In the area of the cover 42, further structural configurations for fastening this area to the supporting structure of the tent roof can be seen, with this fastening being of no relevance for the present invention.

Figure 7A:
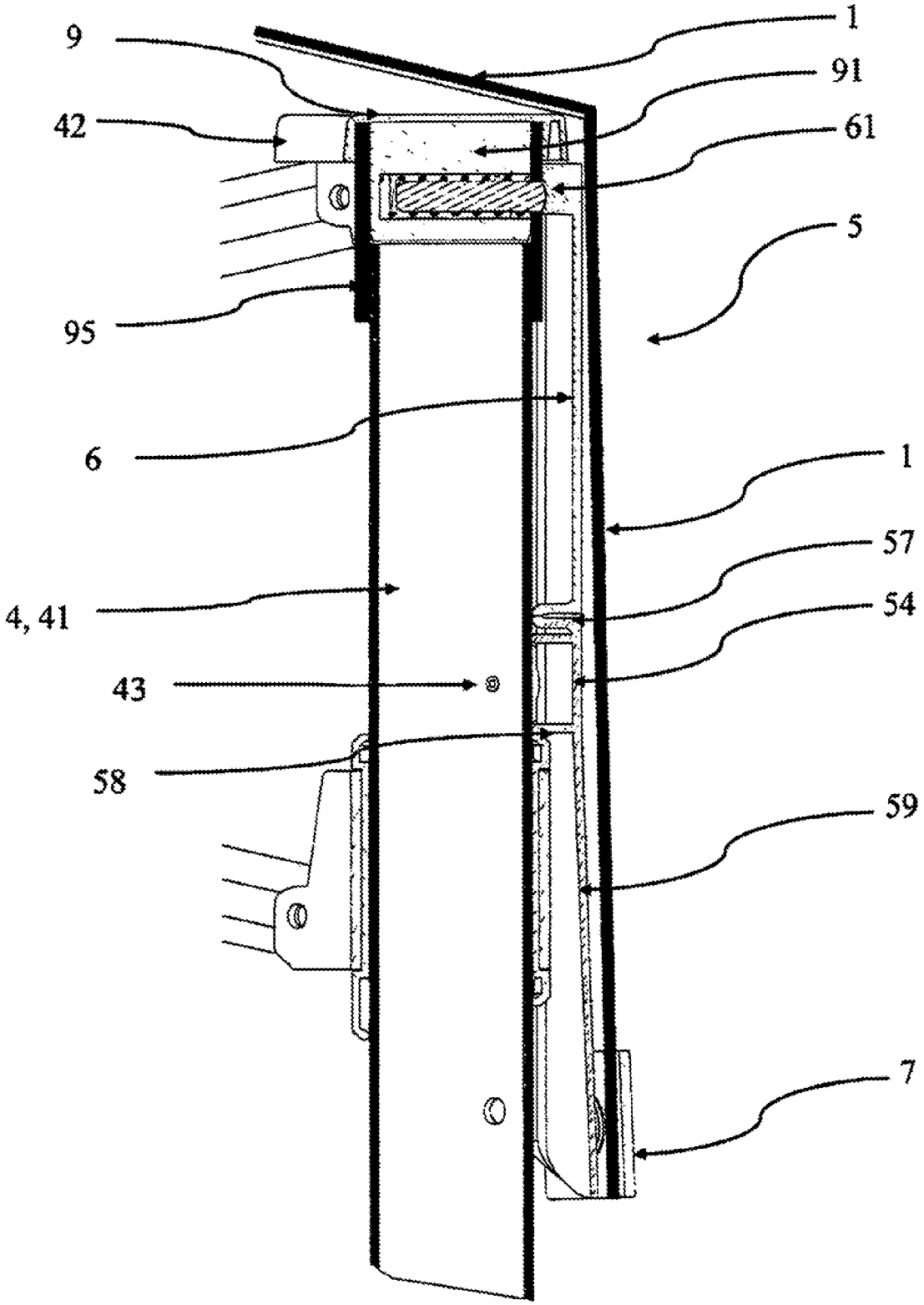
FIG. 7A, 7B schematic diagrams of FIG. 6 in side view showing the tensioning device, the corner protection device with the tensioning element and the fastening element in sectional view.

FIGS. 7A and B show the arrangement and configuration of the tensioning device 9, the corner protection device 5, the tensioning element 6 as well as the fastening element 7 in side view. The tensioning device 9 can be seen in detail in FIG. 7 as well as in FIG. 9. FIG. 7A shows the situation with the tensioning element head "retracted" and FIG. 7B with the tensioning element head "extended".

Figure 7B:
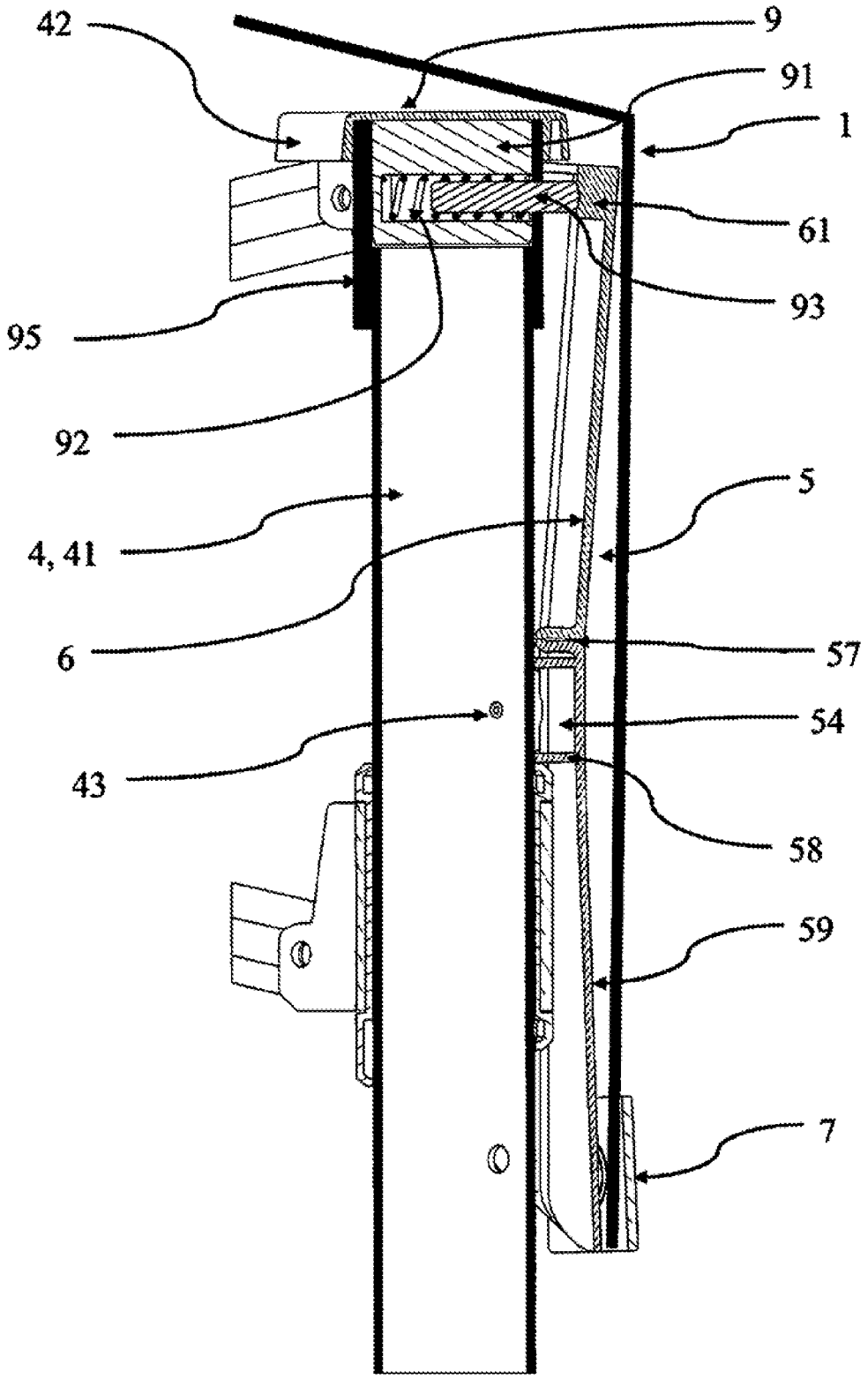

The tensioning device 9 is arranged on the outer side of the upper section 41 of the support 4, as can be clearly seen in FIGS. 7A and 7B. The corner protection device 5 is fastened to the upper section 41 of the support 4 in the area of the hinge section 54. Reference numeral 43 shows a rivet counter-holder on the inner side of the support 4, by means of which a fixed rivet connection to the rivet is made, which is inserted into the recess of the corner protection device 5 shown in FIG. 4 and FIG. 5 through the latter and guided to the rivet counter-holder through a corresponding opening in the support 4.

In FIGS. 7A and 7B, the notch 57 in the area of the hinge section 54 can also be seen, through which the corner protection device 5 is given bending flexibility in this area. Therefore, the upper part of the corner protection device 5 can be moved or bent away from its original position in the direction of the arrow shown in relation to the outer side of the upper part 41 of the support 4 to the required extent. Due to the movable configuration of this part of the corner protection device 5, the latter thus assumes the function of the tensioning element 6.

Figure 9:
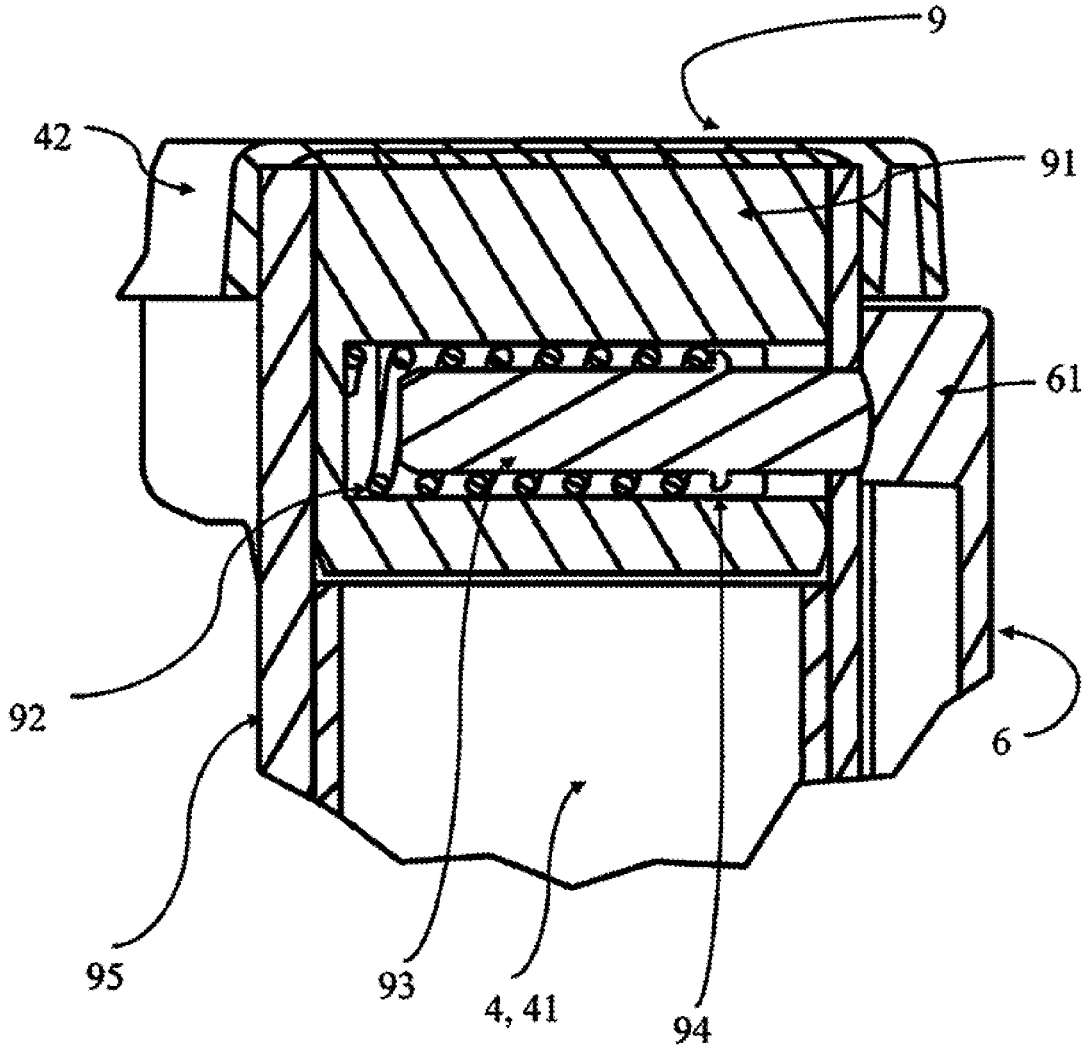
FIG. 9 a sectional view of the tensioning device and the tensioning element.

The movement of the tensioning element 6 away from the vertical axis of the support 4 as shown in a comparison of FIG. 7A with FIG. 7B is achieved by the tensioning device 9, which is illustrated in FIGS. 7A and 7B and in detail in FIG. 9. According to these two figures, the tensioning device 9 has a housing 91, which can be placed on the end area of the upper part 41 of the support 4 by means of a downwardly extending frame projection 95 and, if desired, fastened by further measures. The housing 91 contains an opening running horizontally, into which a spring 92 is inserted. The spring 92 acts on a pressure element 93. For this purpose, this pressure element has a collar 94, on which one end of the spring acts. In this embodiment, the pressure element 93 is configured in the form of a bolt. The pressure element 93 acts on the spatial-geometrical enlargement of the tensioning element 6, with this enlargement 61 being provided in the form of a tensioning element head. FIG. 7A shows an ideal initial state, in which the fabric of the tent roof is (still) in close contact with the support 4 so that the spring 92 has not yet or essentially not yet pressed the pressure element 93 against the tensioning element head 61, which, like the pressure element 93, thus assumes a state in which it is "retracted" into the housing 91. The spring tension presses the pressure element 93 against the tensioning element head 61. As a result, the tensioning element 6 and its tensioning element head 61 press against the tightly fitting fabric of the tent roof 1 in its original tension. If this tent roof expands due to ambient conditions and/or material fatigue, this configuration causes a post-tensioning of the tent roof, which is marked with reference numeral 12 in FIG. 7B.

In order to prevent the fabric of the tent roof from evading the effect of this compressive stress, the fabric, in particular when configured in the form of a screen, is fastened to the lower part 59 of the corner protection device 5 by means of a fastening element 7. In the embodiment as described, the fastening element 7 is configured in the form of a corner bracket 71. For this purpose, the fabric of the tent roof, in particular the fabric of the screen, is fastened in an appropriate manner between the inner side of the fastening element 7 and the outer side of the lower part 59 of the corner protection device. As a result, a counter-stress of the fabric is maintained, i.e. the fabric cannot evade the effect of the compressive stress due to the interaction of the tensioning device 9 with the tensioning element 6, 61.

Figure 8:
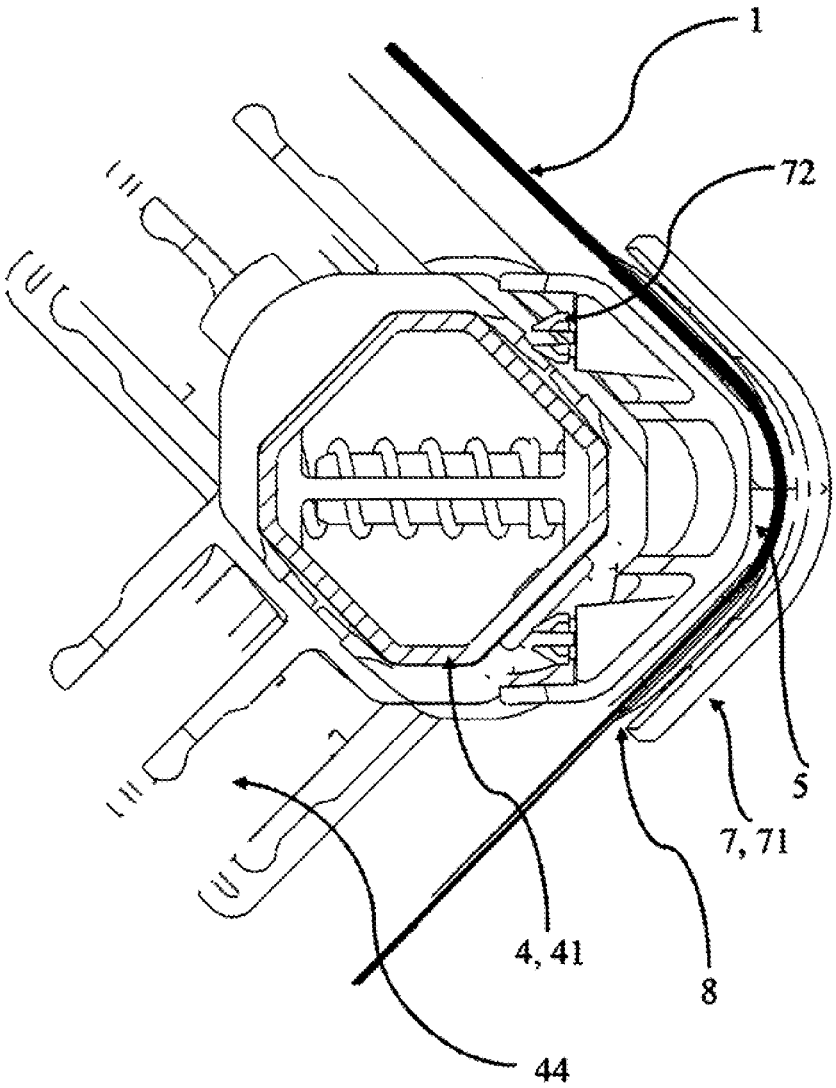
FIG. 8 a schematic diagram of a detailed view of the arrangement of a support and the attachment of the corner protection device and the fastening element as viewed in cross section.

The details of this arrangement can be seen in FIG. 8, which shows a schematic diagram of a plan view in the cross section of the support 4, 41 and the arrangement of the fastening element 7 on the corner protection device 5. Between the corner protection device 5 and the fastening element 7 configured in the form of a corner bracket 71, there is a clearance 8 in the form of a gap, in which the fabric of the tent is received. The fastening element 7 has a fastening member 72, which is provided with a barbed hook. The fastening member 72 passes through a corresponding opening of the corner protection device 5 and is fastened there by means of this barbed hook. This means that a coupling is achieved by engaging. Other options for fastening by means of screws, clamps, Velcro, snap fasteners, eye connections or any other fastening means are, of course, likewise possible.

Figure 10:
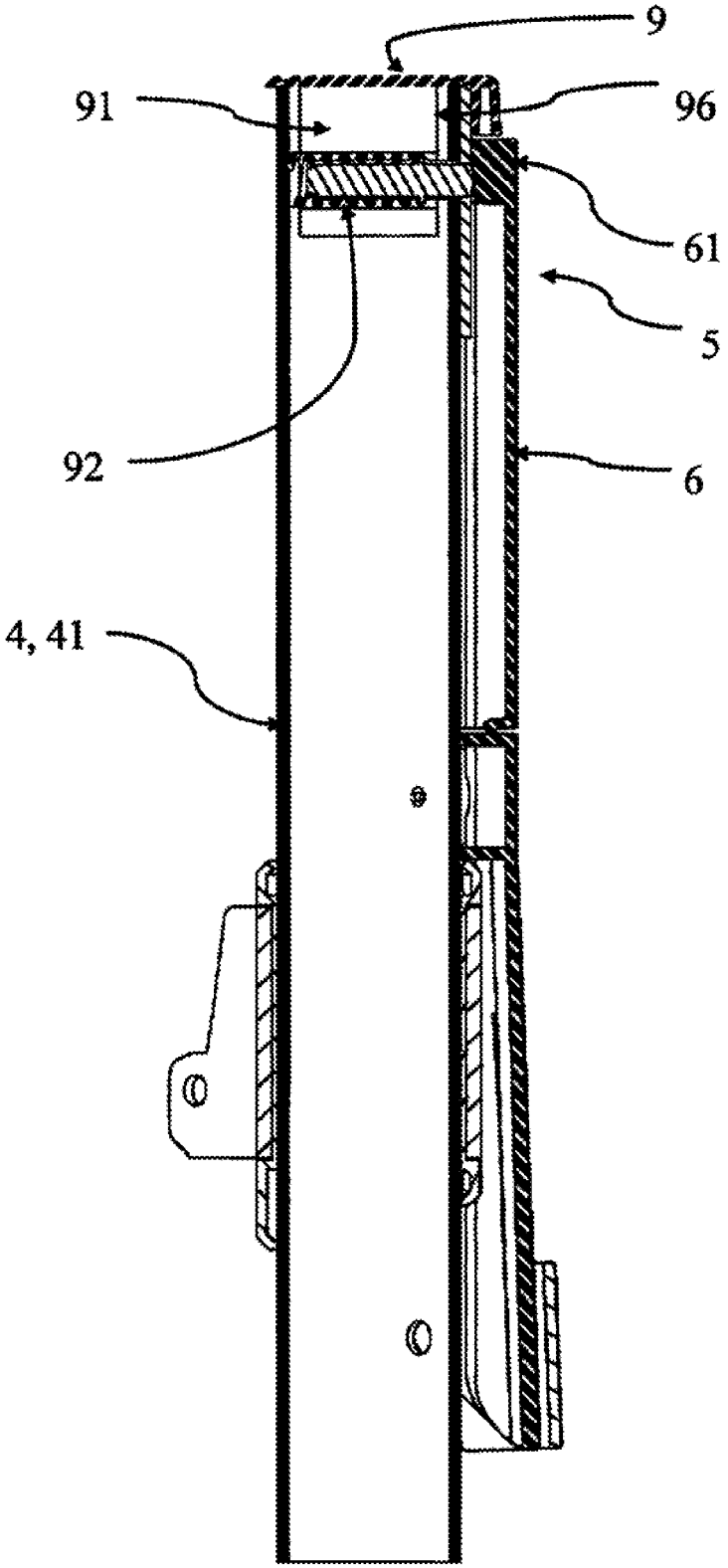
FIG. 10 a sectional view in which the tensioning device is arranged inside the hollow body of the support.

FIG. 10 shows the second embodiment of the present invention in sectional view. Here, a tensioning device 9 is also used, which implements the design principles described above and which interacts in the same way with the corner protection device 5 described above and the tensioning element 6, which is inserted into the hollow body of the support 4, 41.

In this case, the tensioning device 9 either uses the internal space of the support 4, 41 as a housing 96, within which this embodiment is used, or the tensioning device is located inside a housing 91, which is inserted, for example pushed, into the hollow space of the support. In this embodiment, a corresponding opening is provided in the support, through which at least one spring 92 of the tensioning device 9 presses against the tensioning element 6 of the corner protection device 5 in a manner as has been explained in connection with the first-mentioned embodiment.

Since the tensioning device 9 is arranged inside the hollow body of the support 4, 41, it is not necessary for the length of the body of the corner protection device 5 to protrude laterally beyond the upper end of the support 41 of the tent roof.

Figure 11:
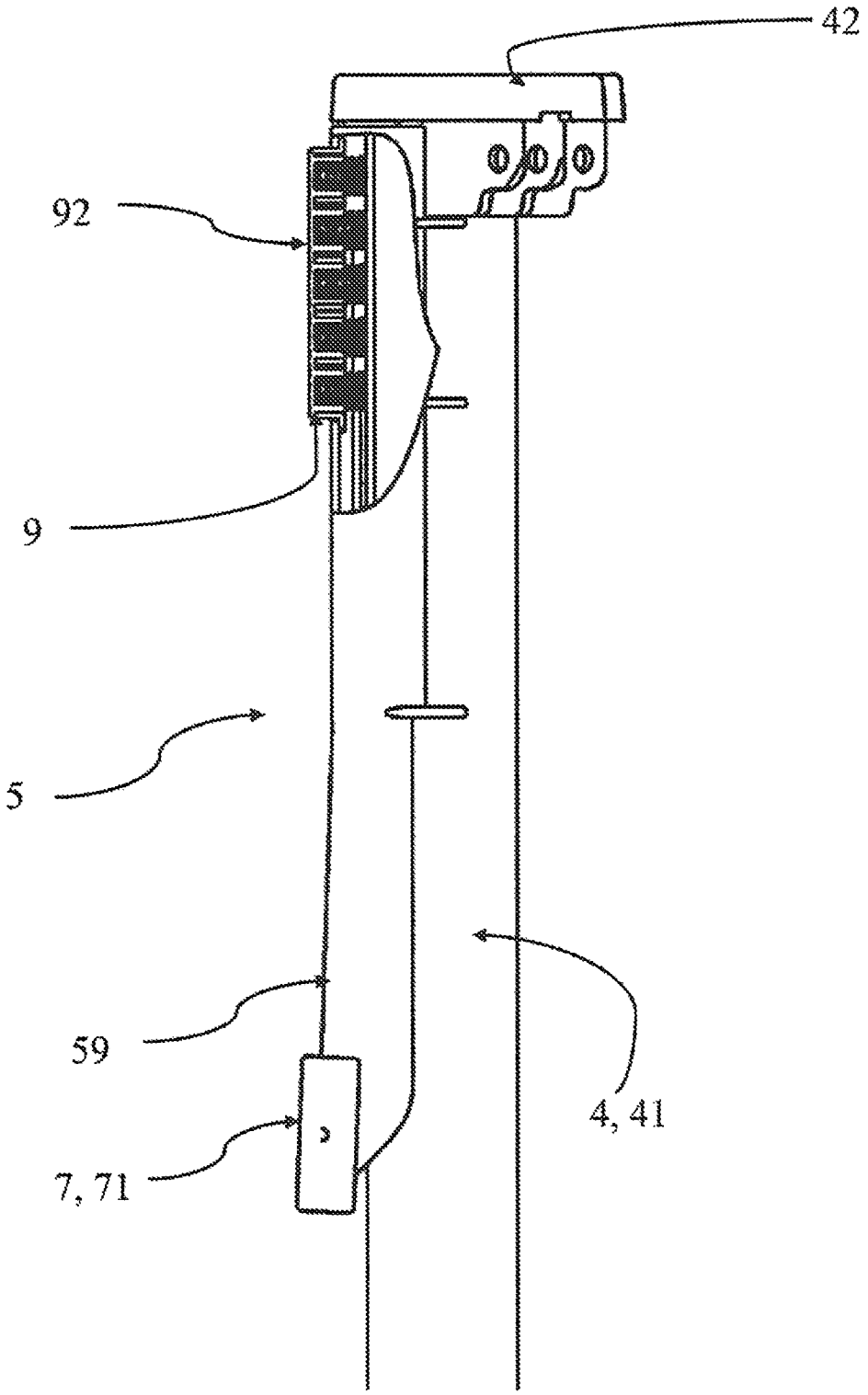
Figure 12:
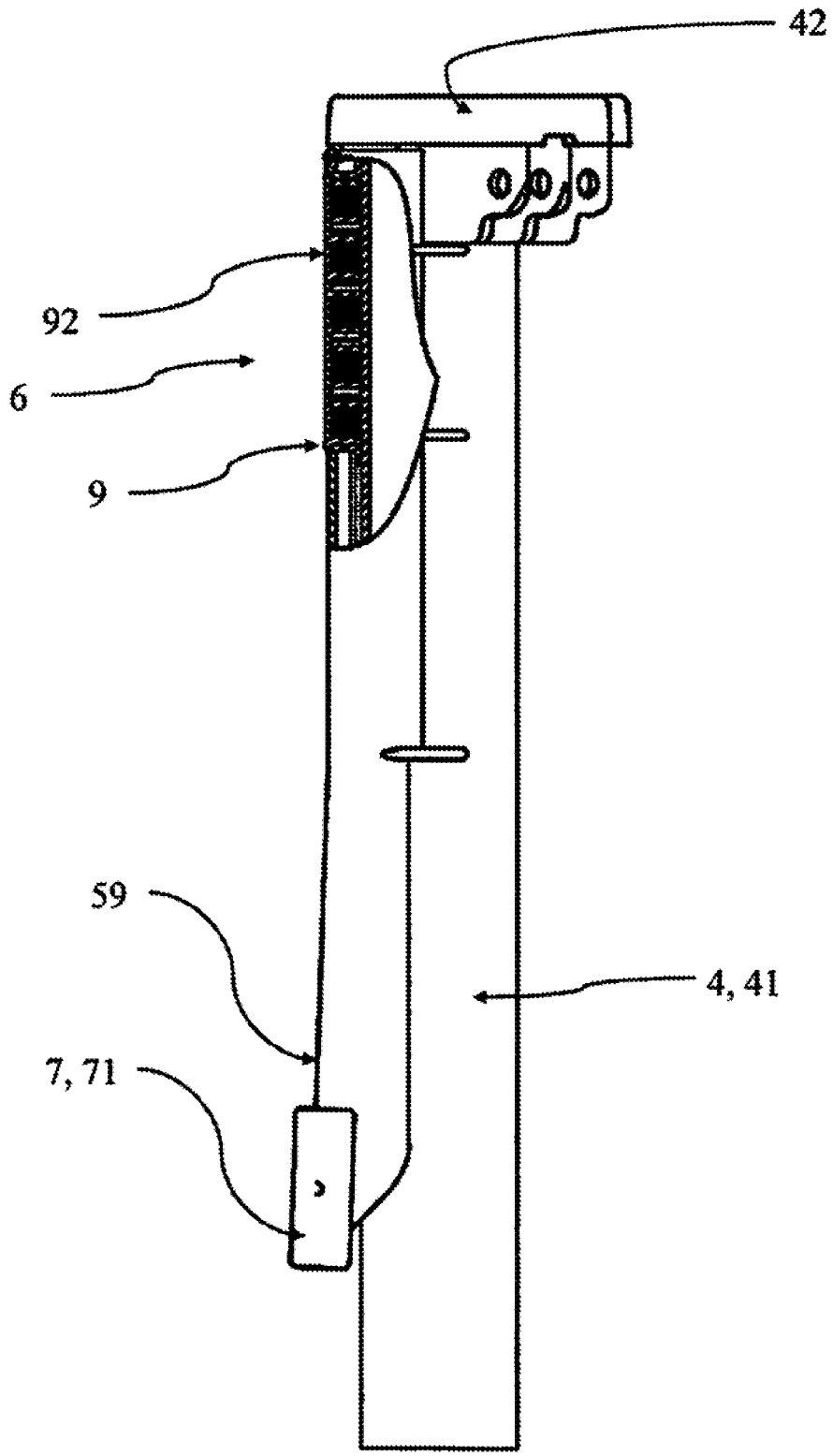
Figure 13:
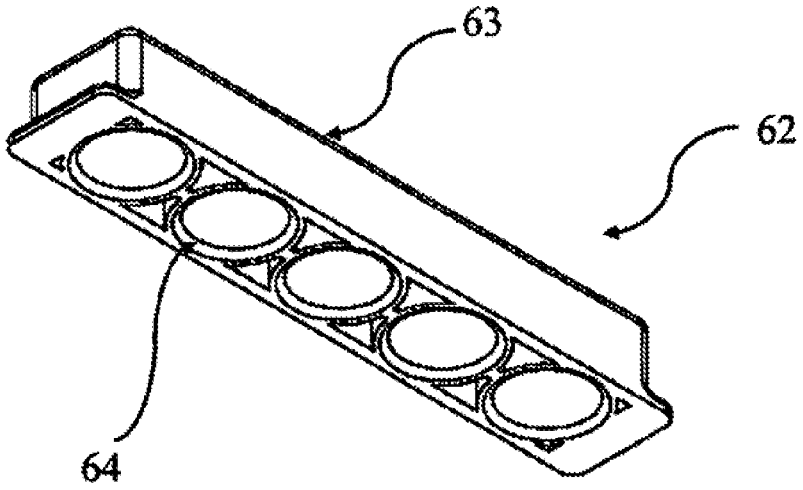
Figure 14:
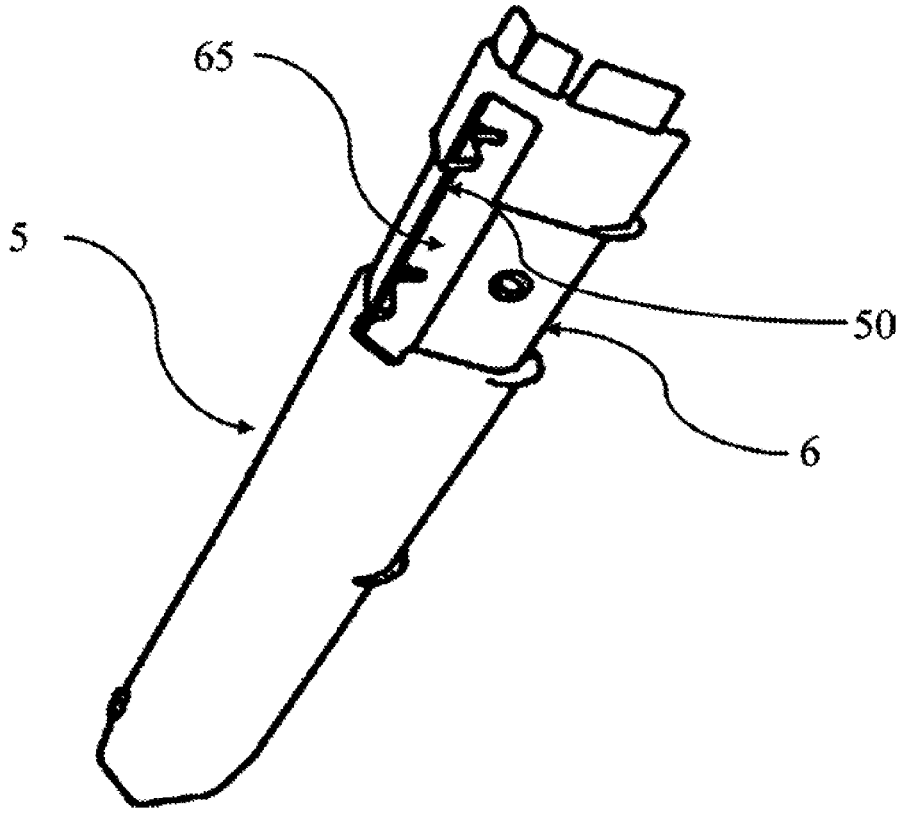
Figure 15:
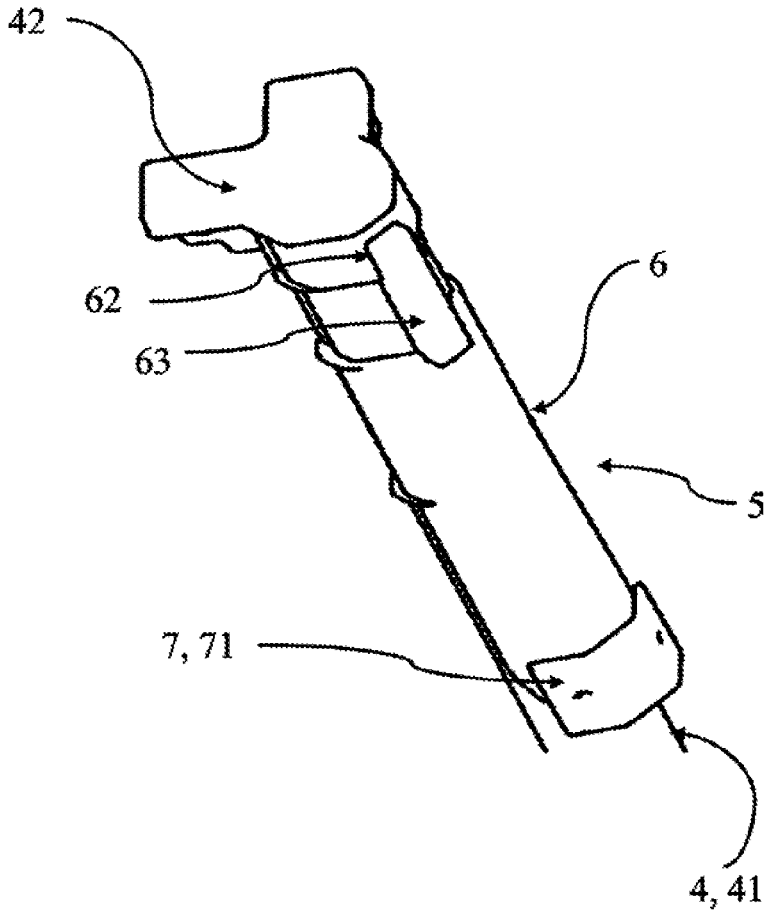

FIG. 11 to FIG. 15 show the third embodiment, with FIG. 11 showing the corner protection device with the "extended" tensioning device and FIG. 12 showing the corner protection device with the "retracted" tensioning device, and FIG. 13 disclosing the tensioning shell, FIG. 14 the opening for the tensioning device in the corner protection device and FIG. 15 the opening for the tensioning device covered by means of the tensioning shell as well as the corner protection device.

In this third embodiment, the tensioning device 9 is an integral component of the corner protection device 5.

The corner protection device 5 is fastened to the support 4, 41 in a manner appropriate in terms of construction. The corner bracket 7, 71 for the fabric of the tent roof is arranged at its lower end 59.

This third embodiment shows that the tensioning device 9 is no longer a direct structural component of the support 4, 41 of the tent, but part of the corner protection device 5 itself.

The corner protection device 5 is attached and fastened to the support 4, 41 of the tent. At its lower end 59, a corner bracket 7,71 is attached to the corner protection device 5.

At the point where the screen 2 of the tent fabric overlaps the corner protection device 5, an opening 65 is provided in the corner protection device 5, which receives the tensioning device 9, cf. FIGS. 11, 12, 14. For this purpose, the tensioning device 9 is arranged on the inner side 50 of the corner protection device 5, hence adjacent to the outer side of the support 4, 41.

The tensioning device 9 preferably protrudes through the opening 65 in the corner protection device 5 in the direction of the fabric of the tent roof. In this example, the opening 65 preferably has a rectangular configuration so that more than one spring of the tensioning device 9 can pass through it. If a plurality of springs is used, a more even distribution of pressure on the fabric of the tent roof, which overlaps the corner protection device 5 in this area, is achieved in this way.

For example, five springs 92 are arranged side by side in FIG. 11 and in FIG. 12. The springs 92 are arranged in an analogous manner on one side thereof in the tensioning device 9 and end at their other end, which is directed towards the fabric web, in corresponding pot-shaped receptacles 64, which serve to hold these ends of the springs and which in turn are arranged in a tensioning shell 62, as can be seen in FIG. 13. This tensioning shell is thus open towards the springs, while it has a smooth, closed surface 63 towards the fabric of the tent roof.

The springs 92 thus press into the pot-shaped receptacles 64 of the tensioning shell 62, which in this way presses with its smooth, closed surface 63 against the screen 2 of the fabric of the tent roof. This results in a visually even tension of the fabric of the tent roof.

Altogether, the functional principle can be described in such a way that the springs together with the tensioning shell are more or less retracted in the corner protection device 5 in their original state, FIG. 12, and thus create a smooth surface of the corner protection device 5 in the area of its opening. If the fabric of the tent roof expands, the springs with the tensioning shell extend out of their holder, FIG. 11, and press against the fabric of the tent roof, thereby causing it to be permanently and evenly tensioned.

In this third embodiment, it is clear that the corner protection device itself does not have to be configured so as to be partially movable, as has been described, for example, for the previous embodiments, because it is not the corner protection device itself which moves against the fabric web of the tent as a result of the pressure of the springs, but because this function is performed by the configuration of the springs with the tensioning shell described above.

Figure 16A:
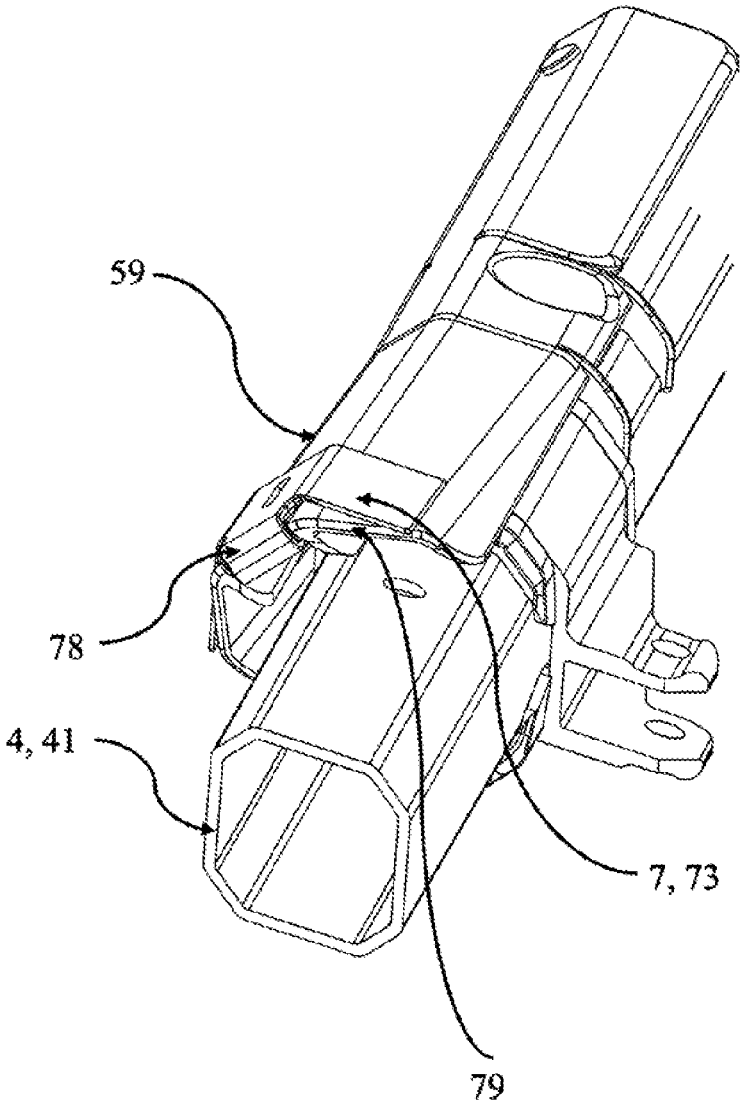

The group of FIGS. 16A, B, C and D shows a further embodiment of the fastening element 7, which has a polygonal shape.

FIG. 16A shows an overall view, from which the arrangement of the support 4, 41, the lower part 59 of the corner protection device 5 and the arrangement of the fastening element 7 can be seen. The tent fabric 1 of the tent is fastened to the upper side of the fastening element 7, as can be seen in FIG. 16C when viewed from the inner side. This results in the sandwich-like structure.

The fastening element 7 is configured in the form of a plastic part 73, which can be fastened, for example sewn on, to the inner side of the fabric of the tent roof 1, in particular to the inner side of the screen 2 (FIG. 1) of the tent roof 1, cf. FIG. 16C. On its side facing away from the fabric of the tent roof 1, the sewable plastic part 73 is connected to the lower part 59 of the corner protection device 5 (FIGS. 16B, 16C).

Figure 16B:
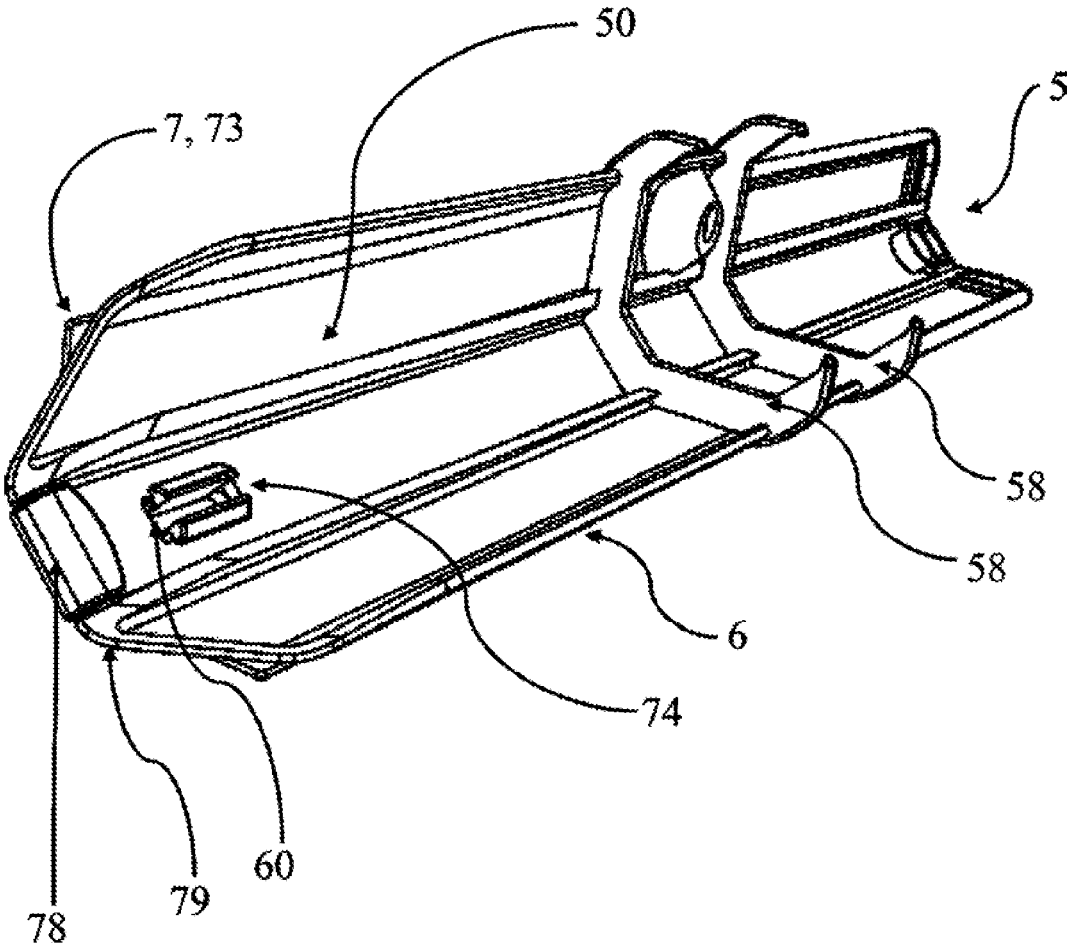
Figure 16C:
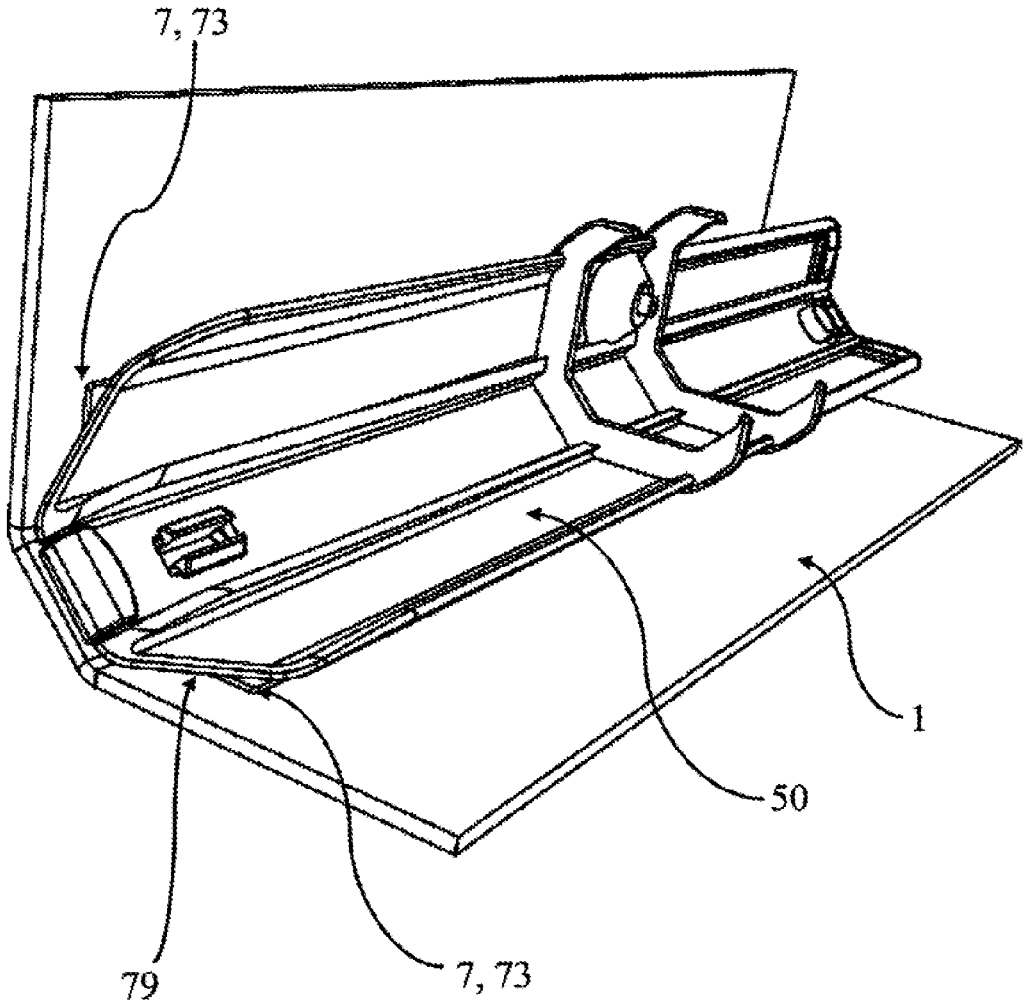

In this embodiment, the connection of the fastening element is configured in such a manner that the plastic part 73 has a hook corner clip 74 approximately in the center, which is inserted through a corresponding opening 60 in the lower part 59 of the corner protection device 5 and which hooks there on the inner side 50 of the lower part 59 of the corner protection device 5; for this purpose, the hook corner clip 74 has snap-in counter-latches 75, 76 (FIGS. 16B, 16C). Furthermore, the plane 77 of the surface of the plastic part 73 can be seen in FIGS. 16A and 16E. FIG. 16E shows the corner clip 74 from its inner side with the hook 78 bent inwards and the counter-latches 75, 76, which are inserted through the opening 60 of the lower part 59 and hook there on the inner side.

In addition, it can be seen from FIGS. 16A, 16B and 16C that the fastening element 7 configured in the form of a plastic part 73 has a tongue-like hook 78 on its side which, when sewn on, is located at the bottom and which encompasses the lower end face 79 of the lower part 59 of the corner protection device so that further stabilization of the fastening between the tent roof and the corner protection device occurs.

Figure 16D:
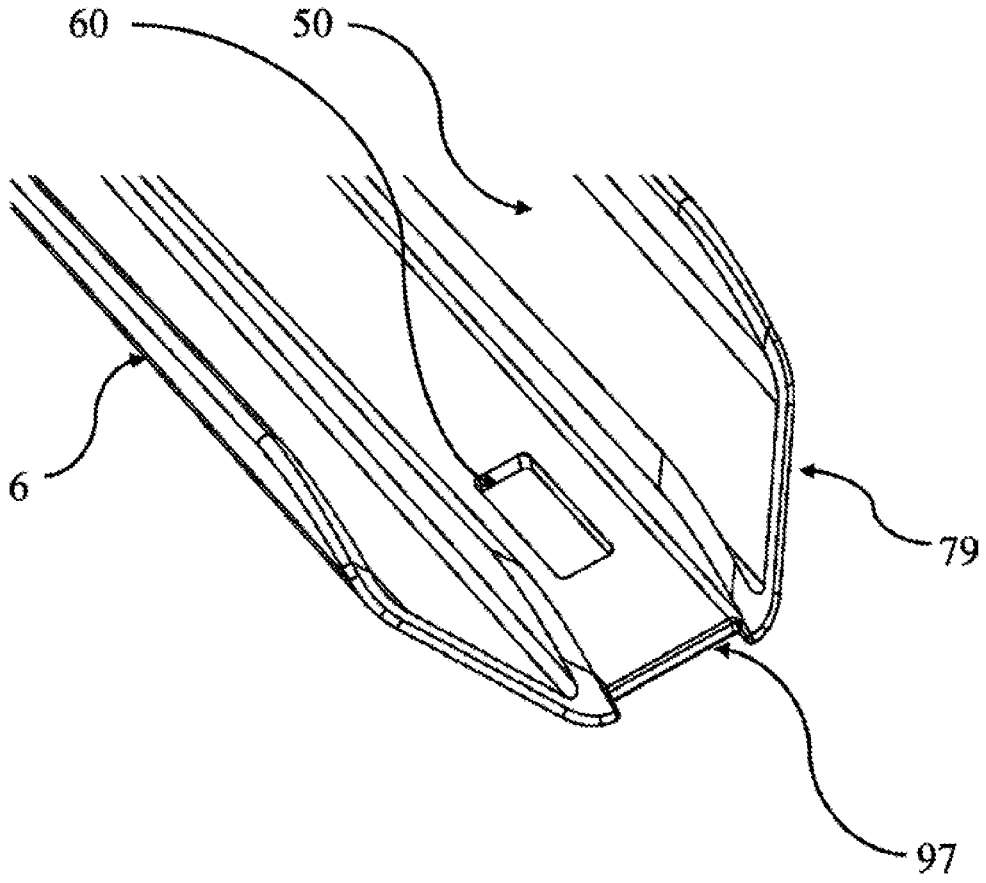
Figure 16E:
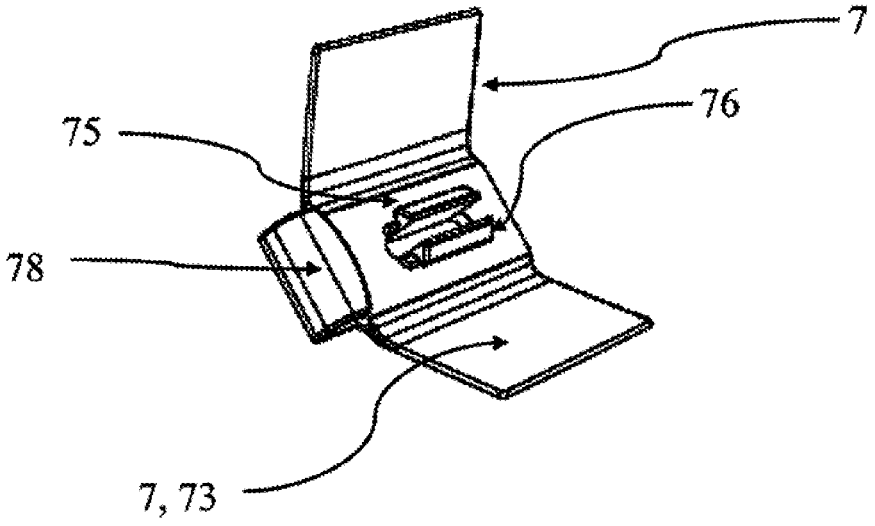

As can be seen from FIG. 16D, it is suitable with regard to fastening to hook in the tent roof 1 on the lower part 59 of the corner protection device 5, more precisely at the position 1, and then clip it into the opening 60. For this purpose, a recess 97 is provided for the hook 78 at the lower end face 79 of the part 59 so that the hook 78 can be fixed in a non-slip manner.

List of Reference Numerals

1. tent roof, tent fabric
2. screen
3. foot
4. support
5. corner protection device
6. tensioning element
7. fastening element
8. clearance for the tent fabric
9. tensioning device
10. remains unassigned
11. tent roof with original tension
12. tent roof after post-tensioning
13.-40. remain unassigned
41. upper part of the support 4
42. cover
43. rivet counter-holder
44. scissor-type grid
45.-48. remain unassigned
49. outer side of the corner protection device
50. inner side of the corner protection device
51. outer side of the corner protection device
52. segment of the corner protection device
53. segment of the corner protection device
54. hinge section
55. reinforcing rib
56. recess for the rivet
57. notch
58. reinforcement ring
59. lower part of the corner protection device 5
60. opening
61. tensioning element head
62. tensioning shell
63. surface of the tensioning shell
64. pot-shaped opening of the tensioning shell
65. opening
66.-70. remain unassigned
71. corner bracket
72. fastening member
73. plastic part
74. hook corner clip
75. counter-latch
76. counter-latch
77. plane of the plastic part
78. hook
79. lower end face
80.-90. remain unassigned
91. housing for the spring
92. spring
93. pressure element

94. collar of the pressure element
95. frame projection
96. housing for the spring
97. recess

The invention claimed is:

1. Device for tensioning a fabric of a tent comprising:
a tensioning device comprising a pressure element, and a housing in which a spring and the pressure element are arranged;
a corner protection device comprising at least one lower part, and a tensioning element comprising a tensioning element head, on which the pressure element abuts; and
a fastening element, arranged on the lower part of the corner protection device;
wherein the tensioning device presses against the tensioning element of the corner protection device, on which the fabric of the tent can be arranged.

2. Device according to claim 1, characterized in that a hinge section is provided between the tensioning element and the at least one lower part of the corner protection device.

3. Device according to claim 1, characterized in that the spring presses the pressure element against the tensioning element.

4. Device according to claim 3, characterized in that the pressure element presses against the tensioning element head of the tensioning element.

5. Device according to claim 1, characterized in that the pressure element has a collar, against which the spring presses.

6. Device according to claim 1, characterized in that the pressure element is configured in the form of a bolt.

7. Device according to claim 1, characterized in that the tensioning device can be arranged on the upper end of at least one support of the tent.

8. Device according to claim 7, characterized in that the tensioning element head protrudes beyond the upper end of the at least one support of the tent.

9. Device according to claim 1, characterized in that the fastening element at least partially overlaps the lower part of the corner protection device.

10. Device according to claim 9, characterized in that the fastening element is connected to the corner protection device of the tent by means of at least one fastening member.

11. Device according to claim 1, characterized in that the fastening element is a plastic part, which is configured in such a manner that it can be fastened to the corner protection device.

12. Device according to claim 11, characterized in that the plastic part has a hook corner clip, by means of which a connection to the corner protection device is established.

13. Device according to claim 11, characterized in that the plastic part has a hook, which is configured in such a manner that it can encompass the end face of the corner protection device.

14. A tent having a device for tensioning the tent fabric according to claim 1.

15. Device for tensioning a fabric of a tent comprising:
a tensioning device comprising at least one spring;
a corner protection device on which the fabric of the tent can be arranged, the corner protection comprising an opening, and a lower part; and
a fastening element;
wherein the tensioning device can be guided through the opening of the corner protection device; and
wherein the fastening element is arranged on the lower part of the corner protection device.

16. Device according to claim 15, characterized in that the fastening element at least partially overlaps the lower part of the corner protection device.

17. Device according to claim 15, characterized in that the fastening element is connected to the corner protection device of the tent by means of at least one fastening member.

18. Device according to claim 15, characterized in that an opening is provided in the corner protection device, which receives the tensioning device.

19. Device according to claim 15, characterized in that the tensioning device has a tensioning shell.

20. Device according to claim 15, characterized in that the at least one spring is arranged in a manner on one side thereof in the tensioning device and ends at its other end, which is directed towards a web of the fabric of the tent, in a corresponding pot-shaped receptacle, which serves to hold this end of the spring and which in turn is arranged in a tensioning shell.

21. Tent having a device for tensioning the tent fabric according to one or more of the preceding claims 15.

* * * * *